US010890196B2

(12) United States Patent
Hashimoto et al.

(10) Patent No.: US 10,890,196 B2
(45) Date of Patent: Jan. 12, 2021

(54) DUMMY RING ASSEMBLY FOR REMOVING VANE SEGMENTS, AND METHOD OF REMOVING VANE SEGMENTS USING SAME

(71) Applicant: Mitsubishi Hitachi Power Systems, Ltd., Kanagawa (JP)

(72) Inventors: Takuro Hashimoto, Tokyo (JP); Kunihiko Waki, Tokyo (JP); Kenichi Arase, Tokyo (JP)

(73) Assignee: MITSUBISHI POWER, LTD., Kanagawa (JP)

( * ) Notice: Subject to any disclaimer, the term of this patent is extended or adjusted under 35 U.S.C. 154(b) by 628 days.

(21) Appl. No.: 15/032,097

(22) PCT Filed: Oct. 7, 2014

(86) PCT No.: PCT/JP2014/076824
§ 371 (c)(1),
(2) Date: Apr. 26, 2016

(87) PCT Pub. No.: WO2015/079805
PCT Pub. Date: Jun. 4, 2015

(65) Prior Publication Data

US 2016/0333892 A1 Nov. 17, 2016

(30) Foreign Application Priority Data

Nov. 26, 2013 (JP) ..... 2013-243727

(51) Int. Cl.
*F04D 29/64* (2006.01)
*F04D 29/54* (2006.01)
(Continued)

(52) U.S. Cl.
CPC ..... *F04D 29/644* (2013.01); *F01D 5/005* (2013.01); *F01D 9/041* (2013.01); *F01D 25/246* (2013.01);
(Continued)

(58) Field of Classification Search
CPC ..... F01D 25/285; F01D 25/246; F01D 25/28; F01D 5/005; F01D 9/041; F01D 9/042;
(Continued)

(56) References Cited

U.S. PATENT DOCUMENTS 3,493,212 A 2/1970 Scalzo et al.
3,673,668 A * 7/1972 Crook ..... B23P 19/025 29/254
(Continued)

FOREIGN PATENT DOCUMENTS

CN 101569989 11/2009
CN 101684813 3/2010
(Continued)

OTHER PUBLICATIONS

International Search Report dated Jan. 6, 2015 in International Application No. PCT/JP2014/076824.
(Continued)

*Primary Examiner* — Lee D Wilson
*Assistant Examiner* — Seahee Hong
(74) *Attorney, Agent, or Firm* — Wenderoth, Lind & Ponack, L.L.P.

(57) ABSTRACT

A dummy ring assembly for removal is provided with a plurality of dummy rings. Each of the dummy rings has a dummy shroud section fitted into a vane ring groove of a casing into which a shroud of a vane segment is fitted, and has an arc shape whose central angle centered on a rotational axis is less than 90°. The dummy shroud sections of the plurality of dummy rings are fitted sequentially into the vane
(Continued)

ring groove of the casing. The vane segment is removed from the casing by moving the dummy rings in a circumferential direction along the vane ring groove.

10 Claims, 21 Drawing Sheets

(51) Int. Cl.
*F04D 29/52* (2006.01)
*F01D 25/24* (2006.01)
*F01D 5/00* (2006.01)
*F01D 9/04* (2006.01)

(52) U.S. Cl.
CPC ..... *F04D 29/522* (2013.01); *F04D 29/542* (2013.01); *F05D 2220/31* (2013.01); *F05D 2220/32* (2013.01); *F05D 2230/70* (2013.01)

(58) Field of Classification Search
CPC ..... F01D 9/04; B23P 19/04; B23P 2700/13; B23Q 3/063
USPC ..... 29/889.1, 889.2, 281.1–281.6
See application file for complete search history.

(56) References Cited

U.S. PATENT DOCUMENTS 3,886,644 A * 6/1975 Koch, Jr. ..... B25B 27/0035 29/270
4,096,614 A * 6/1978 Brungard ..... F01D 9/042 29/244
4,141,124 A * 2/1979 Ryan ..... B23P 6/005 29/252
6,082,963 A 7/2000 Sexton et al.
8,157,620 B2 * 4/2012 Corn ..... B24B 19/009 451/524
10,060,449 B2 * 8/2018 I ..... F01D 25/246
2006/0021680 A1 * 2/2006 Li ..... C22C 14/00 148/407
2007/0120443 A1 * 5/2007 Dollgast ..... H01L 41/053 310/328
2008/0282541 A1 11/2008 Anderson et al.
2009/0265908 A1 10/2009 Corn et al.
2010/0071183 A1 * 3/2010 McCarvill ..... F01D 9/041 29/244
2012/0233837 A1 * 9/2012 Bartlam ..... F01D 5/3038 29/426.1
2012/0317772 A1 * 12/2012 Herbold ..... F01D 25/285 29/402.01
2013/0206737 A1 * 8/2013 Holmes ..... F01D 25/285 219/121.67
2014/0150248 A1 6/2014 Corn et al.

FOREIGN PATENT DOCUMENTS

EP 2 500 529 9/2012
JP 09-004411 1/1997
JP 2000-356108 12/2000
JP 2004-116379 4/2004
JP 2009-264379 11/2009
JP 2010-77966 4/2010
JP 4859984 1/2012
JP 2012-246123 12/2012
JP 2012-246124 12/2012
WO 2009/054050 4/2009

OTHER PUBLICATIONS

Written Opinion of the International Searching Authority dated Jan. 6, 2015 in International Application No. PCT/JP2014/076824 (with English translation).

* cited by examiner

DUMMY RING ASSEMBLY FOR REMOVING VANE SEGMENTS, AND METHOD OF REMOVING VANE SEGMENTS USING SAME

TECHNICAL FIELD

The present invention relates to a dummy ring assembly for removing vane segments and a method of removing vane segments using the same. This application claims priority based on Japanese Patent Application No. 2013-243727 filed in Japan on Nov. 26, 2013, the contents of which are incorporated herein by reference.

BACKGROUND ART

Types of rotary machines include axial flow rotating machines. The axial flow rotating machine is provided with a rotor that rotates about an axial line, a casing that covers the rotor so as to allow the rotor to rotate, and a plurality of vane rings that have an annular shape centered on the axial line and are provided on an inner circumferential side of the casing. The plurality of vane rings are arranged in the axial direction. In this type of axial flow rotating machine, from the viewpoint of ease of assembly and the like, the casing is able to be split into a plurality of partial casings, and the vane ring is also able to be split into a plurality of vane segments in the circumferential direction. Vane ring grooves recessed from the inner side in the radial direction toward the outer side in the radial direction and extending in the circumferential direction are formed in the partial casings. Each vane segment is fitted into a vane ring groove in one of the partial casings.

Incidentally, in a case of inspecting and repairing the inside of a rotary machine such as that described above, it is necessary to remove the vane segments from the partial casings. Patent Document 1, listed below, discloses a method for removing two arc-shaped vane segments from a semi-cylindrical lower casing (partial casing) of a gas turbine, which is a type of axial flow rotating machines.

In this method, a semicircular-arc-shaped roll cage assembly attached to the lower casing so as to face the lower casing and a semicircular-arc-shaped dummy section that is fitted into the vane ring groove of the lower casing are prepared in advance. Next, both ends of the semicircular-arc-shaped dummy section in the circumferential direction are respectively connected to the vane segments fitted into the vane ring groove of the lower casing. A ring is formed by the dummy section and the two vane segments as a result. Next, the semicircular-arc-shaped roll cage assembly is made to face the lower casing and is then connected to the lower casing. The dummy section and the two vane segments are then rotated integrally by 180° along the inner circumferential side of the lower casing and the roll cage assembly. As a result, the dummy section is contained within the lower casing, and conversely, the two vane segments separate from the lower section.

CITATION LIST

Patent Document

Patent Document 1: Japanese Unexamined Patent Application Publication No. 2000-356108A

SUMMARY OF INVENTION

Technical Problem

According to the method disclosed in the above-described Patent Document 1, it is necessary to prepare the semicircular-arc-shaped roll cage assembly and the semicircular-arc-shaped dummy section. The roll cage assembly and the dummy section both have a semicircular-arc shape with a long arc length, and thus are expensive to manufacture. Furthermore, it is necessary to manufacture a dummy section for each of the plurality of vane rings in accordance with the shape, dimensions, and so on of each of the vane rings. In other words, the method disclosed in the above-described Patent Document 1 has a problem in that it is expensive to remove the vane segments.

In light of the above problem, an object of the present invention is to provide a dummy ring assembly for removal that can suppress the cost of removing vane segments from a casing, and a method of removing vane segments using the same.

Solution to Problem

To solve the aforementioned problem, a dummy ring assembly for removing vane segments according to one aspect of the invention is a dummy ring assembly for removing vane segments used in a rotary machine. The rotary machine includes a cylindrical casing centered on an axial line and a vane ring mounted in a vane ring groove, the vane ring groove having an annular shape centered on the axial line and being formed in an inner circumferential side of the casing. The casing is able to be split into a plurality of partial casings in a circumferential direction centered on the axial line, and the vane ring is able to be split into a plurality of vane segments in the circumferential direction. The dummy ring assembly includes a plurality of dummy rings, each of the dummy rings having a dummy shroud section fitted into the vane ring groove, having an arc shape whose central angle centered on the axial line is less than 90°, and being capable of moving in the circumferential direction along the vane ring groove.

The following procedure is performed to remove the vane segments from one of the partial casings by using the dummy ring assembly for removal. First, the dummy shroud section of a first dummy ring of the plurality of dummy rings is fitted into the vane ring groove of one of the partial casings, and the first dummy ring is moved in the circumferential direction. Once the entirety in the circumferential direction Dc of the dummy shroud section of the first dummy ring is within the vane ring groove, the dummy shroud section of a remaining second dummy ring of the plurality of dummy rings is fitted into the vane ring groove of the one of the partial casings and butted against the first dummy ring, and the second dummy ring is moved in the circumferential direction Dc along with the first dummy ring. One of the vane segments that has protruded from the vane ring groove of the one of the partial casings during the process of moving the first dummy ring or the process of moving the first and second dummy rings is then pulled out from the one of the partial casings.

Thus, in the case where the dummy ring assembly for removal is used, mounting a plurality of dummy rings in one of the partial casings and moving the plurality of dummy rings in the circumferential direction as described above pushes the plurality of vane segments in the one of the partial casings out from the one of the partial casings.

Accordingly, using the dummy ring assembly for removal makes it possible to remove the plurality of vane segments from the one of the partial casings even in a state where a rotor of the rotary machine is supported in the partial casing.

Meanwhile, when removing the vane segments, it is sufficient to prepare a plurality of arc-shaped dummy rings that each have a central angle of less than 90°. The cost of removing the vane segments can be suppressed as a result.

Here, in the dummy ring assembly for removing vane segments according to the above-described aspect, a total of the central angles of the plurality of dummy rings may be greater than an angle obtained by subtracting a central angle of one of the vane segments from a central angle of one of the partial casings.

Furthermore, in any one of the above-described dummy ring assemblies for removing vane segments, in the case where the central angle of one of the partial casings is 180° and the central angle of one of the vane segments is 45°, two of the dummy rings may be provided, and each of the two dummy rings may have a central angle greater than or equal to 45° and less than 90°.

Furthermore, in any one of the above-described dummy ring assemblies for removing vane segments, each of the dummy rings may include a fitment attachment portion for attaching a movement force application tool that applies a force for moving the dummy ring in the circumferential direction.

In this case, the fitment attachment portion may be formed in an end surface of each of the dummy rings in the circumferential direction. In addition, a plurality of the fitment attachment portions may be formed in an outer circumferential surface of each of the arc-shaped dummy rings so as to be arranged in the circumferential direction.

Furthermore, in any one of the above-described dummy ring assemblies for removing vane segments, on one side and the other side in an axial direction of a first end portion including a first end surface in the circumferential direction of the dummy shroud section of at least one of the plurality of dummy rings, a tapered surface may be formed so that a width of the dummy shroud section in the axial direction gradually increases as the dummy shroud section extends from the first end surface toward a second end surface in the circumferential direction.

In this case, the first end surface of the one of the dummy rings may be slanted so as to gradually extend from one side toward the other side in the circumferential direction as the first end surface extends from one side toward the other side in the axial direction; and an angle of the tapered surface relative to the circumferential direction at the other side of the dummy shroud section in the axial direction may be smaller than an angle of the tapered surface relative to the circumferential direction at the one side in the axial direction.

Furthermore, any one of the above-described dummy ring assemblies for removing vane segments may further include a pressing tool that is attached so as to be in contact with an end surface of one of the dummy rings in the circumferential direction, makes contact with an end surface in the circumferential direction of an outer shroud of one of the vane segments and an end surface in the circumferential direction of an inner shroud of the one of the vane segments, and presses the one of the vane segments in response to the one of the dummy rings moving.

Furthermore, in any one of the above-described dummy ring assemblies for removing vane segments, the dummy ring may be formed from an aluminum alloy.

To solve the aforementioned problem, a method of removing vane segments according to an aspect of the invention uses any one of the above-described dummy ring assemblies for removing vane segments to remove the vane segments from one of the partial casings. The method includes: a first movement step of moving a first dummy ring of the plurality of dummy rings in the circumferential direction by fitting the dummy shroud section of the first dummy ring into the vane ring groove of the one of the partial casings; a second movement step of moving a remaining second dummy ring of the plurality of dummy rings in the circumferential direction along with the first dummy ring by fitting the dummy shroud section of the second dummy ring into the vane ring groove of the one of the partial casings once the entirety in the circumferential direction of the dummy shroud section of the first dummy ring is within the vane ring groove of the one of the partial casings and butting the second dummy ring against the first dummy ring; and a segment pullout step of pulling out, from the one of the partial casings, one of the vane segments that has protruded from the vane ring groove of the one of the partial casings due to either one of the first movement step and the second movement step being executed.

To solve the aforementioned problem, a dummy ring assembly for removing vane segments according to another aspect of the invention is a dummy ring assembly for removing vane segments used in a rotary machine. The rotary machine includes a cylindrical casing centered on an axial line and a plurality of vane rings that have an annular shape centered on the axial line and are arranged in an axial direction in which the axial line extends. A plurality of vane ring grooves which have an annular shape centered on the axial line and into which outer shrouds of the vane rings are respectively fitted are formed in an inner circumferential side of the casing so as to be arranged in the axial direction. The casing is able to be split into a plurality of partial casings in the circumferential direction centered on the axial line, and each of the vane rings is able to be split into a plurality of vane segments in the circumferential direction. The dummy ring assembly includes an arc-shaped ring piece having an outer diameter dimension smaller than an inner diameter dimension of the outer shroud of each of the vane rings and having an inner diameter dimension greater than an outer diameter dimension of an inner shroud of each of the vane rings, and a groove attachment that is removably attached to the ring piece and is fitted into each of the vane ring grooves.

The following procedure is performed to remove vane segments from the partial casing using the stated dummy ring assembly for removal. First, the groove attachment to be fitted into one of the plurality of vane ring grooves is mounted on the ring piece. Next, the groove attachment mounted on the ring piece is fitted into the one of the vane ring grooves and the ring piece and the groove attachment are moved integrally in the circumferential direction. One of the vane segments that has protruded from the one of the vane ring grooves during this movement process is pulled out from the one of the partial casings. Once all of the vane segments attached to the one of the vane ring grooves have been successfully removed, a groove attachment to be fitted into another vane ring groove is mounted on the ring piece. Next, the groove attachment mounted on the ring piece is fitted into the other vane ring groove and the ring piece and the groove attachment are moved integrally in the circumferential direction. A vane segment that has protruded from the other vane ring groove during this movement process is pulled out from the one of the partial casings.

In the case where the dummy ring assembly for removal is used, moving the ring piece and the groove attachment integrally in the circumferential direction as described above pushes the plurality of vane segments in the partial casing out from the partial casing. Accordingly, using the dummy ring assembly for removal makes it possible to remove the plurality of vane segments from the partial casing even in a state where a rotor of the rotary machine is supported in the partial casing.

In addition, in the case where the dummy ring assembly for removal is used, it is sufficient to use a single ring piece for a plurality of vane ring grooves, which makes it possible to suppress the cost of removing the vane segments.

Here, in the dummy ring assembly for removing vane segments according to the above-described another aspect, the outer diameter dimension of the ring piece may be smaller than an inner diameter dimension of the outer shroud of each of the plurality of vane rings arranged in the axial direction, and the inner diameter dimension of the ring piece may be greater than the outer diameter dimension of the inner shroud of each of the plurality of vane rings arranged in the axial direction, and a plurality of groove attachments that are fitted into the corresponding plurality of vane ring grooves arranged in the axial direction may be provided as the groove attachment.

Furthermore, in any one of the dummy ring assemblies for removing vane segments according to the above-described another aspect, the groove attachment may include an end portion groove attachment mounted on an end portion of the ring piece in the circumferential direction, and a trunk section groove attachment mounted on the ring piece so as to be distanced from the end portion groove attachment in the circumferential direction.

Furthermore, in any one of the dummy ring assemblies for removing vane segments according to the above-described another aspect, an angle around the axial line of the position where the trunk section groove attachment is mounted relative to the position where the end portion groove attachment is mounted may be less than 90°.

To solve the aforementioned problem, a method of removing vane segments according to another aspect of the invention uses any one of the dummy ring assemblies for removing vane segments according to the above-described another aspect to remove the vane segments from the one of partial casings. The method includes: a preparation step of mounting the groove attachment on the ring piece; a movement step of moving the ring piece and the groove attachment integrally in the circumferential direction by fitting the groove attachment mounted on the ring piece into the vane ring groove of the one of the partial casings; and a segment pullout step of pulling out, from the one of the partial casings, one of the vane segments that has protruded from the vane ring groove of the one of the partial casings due to the movement step being executed.

To solve the aforementioned problem, a method of removing vane segments according to yet another aspect of the invention uses any one of the dummy ring assemblies for removing vane segments according to the above-described another aspect to remove the vane segments from the one of the partial casings. The method includes, for each of a plurality of the vane ring grooves of the one of the partial casings:

a preparation step of mounting the groove attachments corresponding to the vane ring groove on the ring piece; a movement step of moving the ring piece and the groove attachments integrally in the circumferential direction by fitting the groove attachments mounted on the ring piece into the vane ring groove; and a segment pullout step of pulling out, from the one of the partial casings, one of the vane segments that has protruded from the vane ring groove due to the movement step being executed.

Advantageous Effects of Invention

According to an aspect of the present invention, the cost of removing the vane segments from the casing can be suppressed. Furthermore, according to an aspect of the present invention, it is not necessary to remove the rotor when removing the vane segments from the casing, which makes it possible to shorten the duration of work.

DESCRIPTION OF EMBODIMENTS

Embodiments of a dummy ring assembly for removing vane segments and a method of removing vane segments using the same according to the present invention will be described hereinafter.

Embodiment of Rotary Machine

An embodiment of a rotary machine provided with vane segments will be described using FIGS. 1 to 4.

Figure 1:
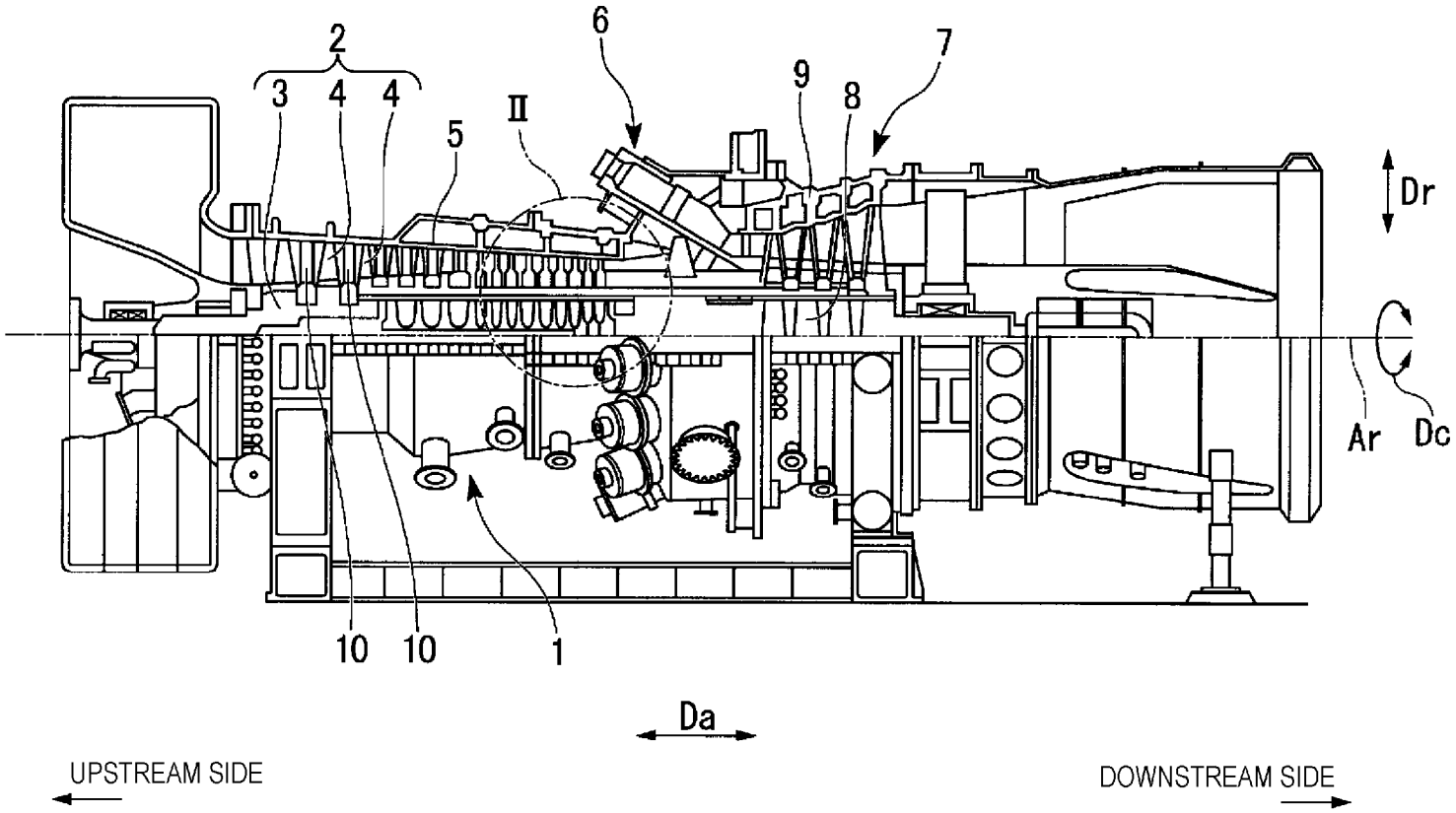
FIG. 1 is a cutaway side view illustrating the main portion of a gas turbine in an embodiment according to the present invention.

The rotary machine according to the present embodiment is a gas turbine. As illustrated in FIG. 1, the gas turbine includes a compressor 1 that compresses outside air to generate compressed air, a combustor 6 that mixes fuel from a fuel supply source with the compressed air and combusts the mixture to generate a combustion gas, and a turbine 7 that is driven by the combustion gas.

The compressor 1 and the turbine 7 are both axial flow rotating machines, and include rotors 2 and 8 that rotate about a rotational axis Ar, and casings 5 and 9 that cover the rotors 2 and 8. The compressor rotor 2 and the turbine rotor 8 rotate about the same rotational axis Ar, and are connected to each other. The combustor 6 is fixed to the turbine casing 9. Hereinafter, the direction in which the rotational axis Ar extends will be referred to as an axial direction Da, a radial direction relative to the rotational axis Ar simply as a radial direction Dr, and a circumferential direction relative to the rotational axis Ar simply as a circumferential direction Dc. Meanwhile, in the axial direction Da, the compressor 1 side relative to the turbine 7 will be referred to as an upstream side, and the opposite side will be referred to as a downstream side.

Figure 2:
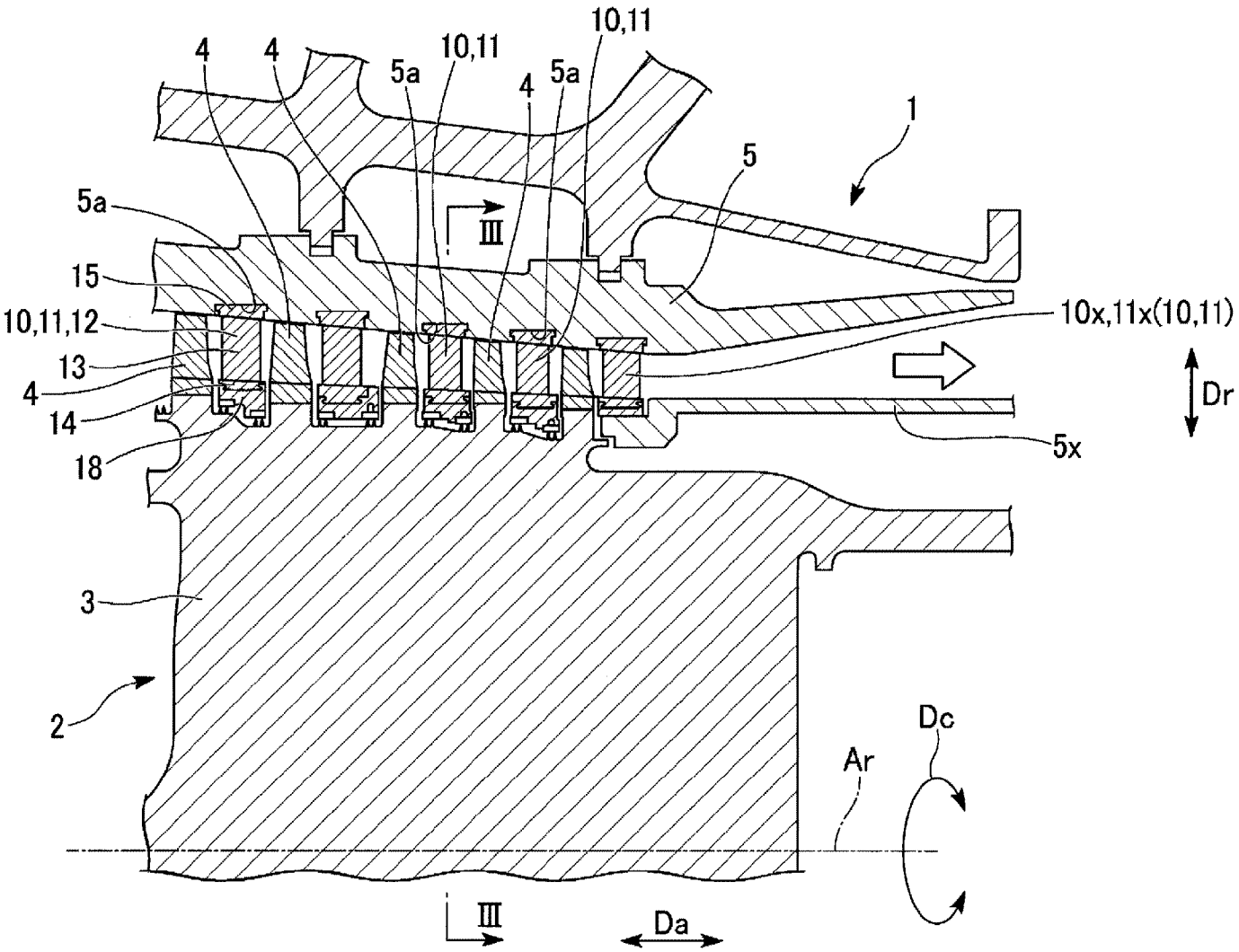
FIG. 2 is a detailed view of an area II indicated in FIG. 1.

As illustrated in FIG. 2, the compressor rotor 2 includes a rotor main body 3 extending in the axial direction Da, and a plurality of blade stages 4 that are fixed to an outer circumference of the rotor main body 3 and are arranged in the axial direction Da. The compressor casing 5 has a cylindrical shape centered on the rotational axis Ar. On the inner circumferential side of the compressor casing 5, an annular vane ring groove 5*a* that is recessed from the inner side in the radial direction toward the outer side in the radial direction and that is centered on the rotational axis Ar is formed in a position on the upstream side of each of the blade stages 4. In other words, a plurality of the vane ring grooves 5*a* are formed on the inner circumferential side of the compressor casing 5, arranged in the axial direction Da. An annular vane ring 10 is attached into each of the vane ring grooves 5*a*, centered on the rotational axis Ar.

Figure 3:
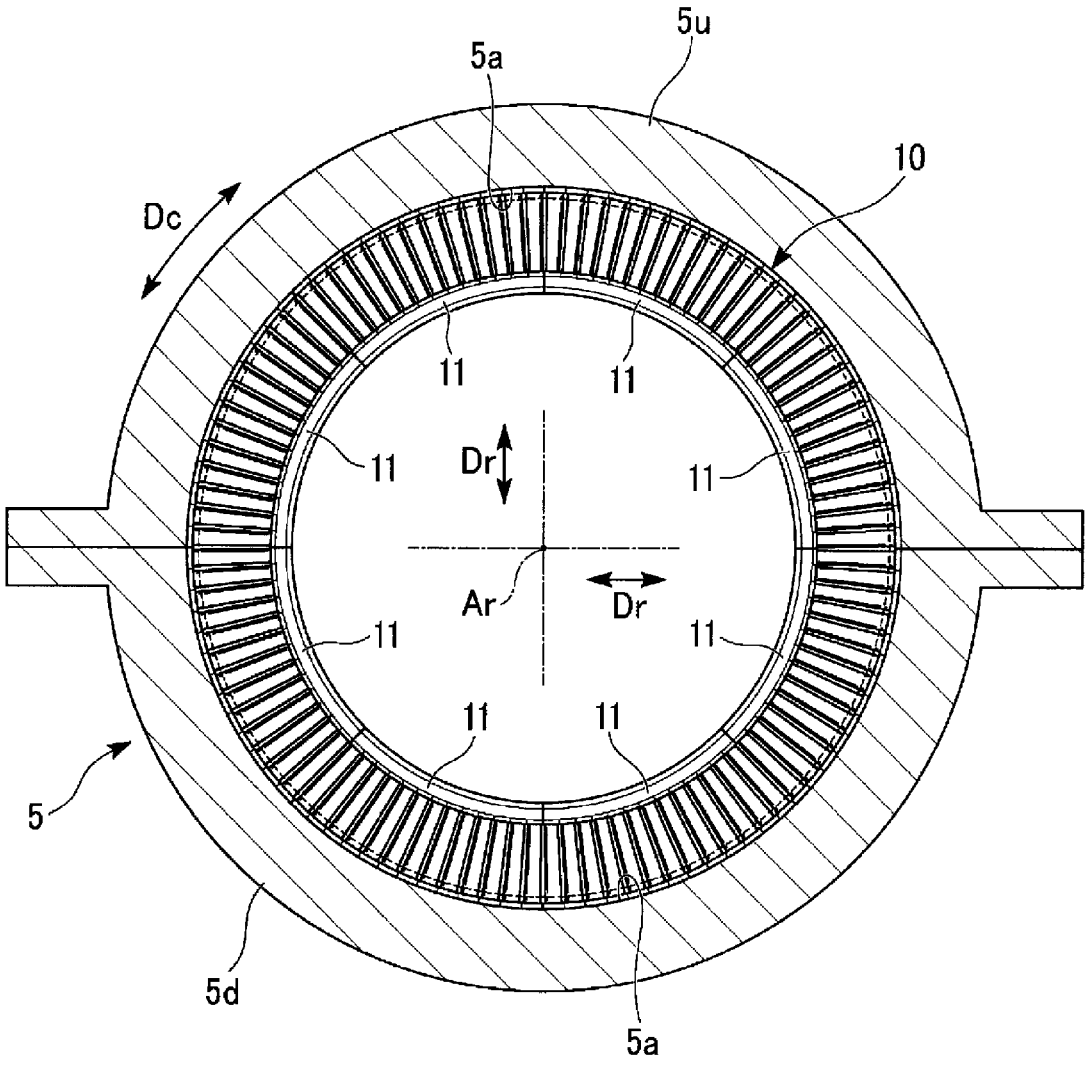
FIG. 3 is a cross-sectional view taken along a line in FIG. 2.

As illustrated in FIG. 3, each vane ring 10 can split into a plurality of vane segments 11 in the circumferential direction Dc for convenience of assembly. Each vane segment 11 has an arc shape centered on the rotational axis Ar. Here, the vane ring 10 can split into eight vane segments 11. As such, here, a central angle of each of the vane segments 11 is 45° (=360°/8). Meanwhile, the compressor casing 5 can split into two semi-cylindrical partial casings 5*u* and 5*d*. Of the two partial casings 5*u* and 5*d*, the partial casing 5*u* constitutes an upper casing 5*u* that forms an upper half of the compressor casing 5, and the other partial casing 5*d* constitutes a lower casing 5*d* that forms a lower half of the compressor casing 5.

Figure 4:
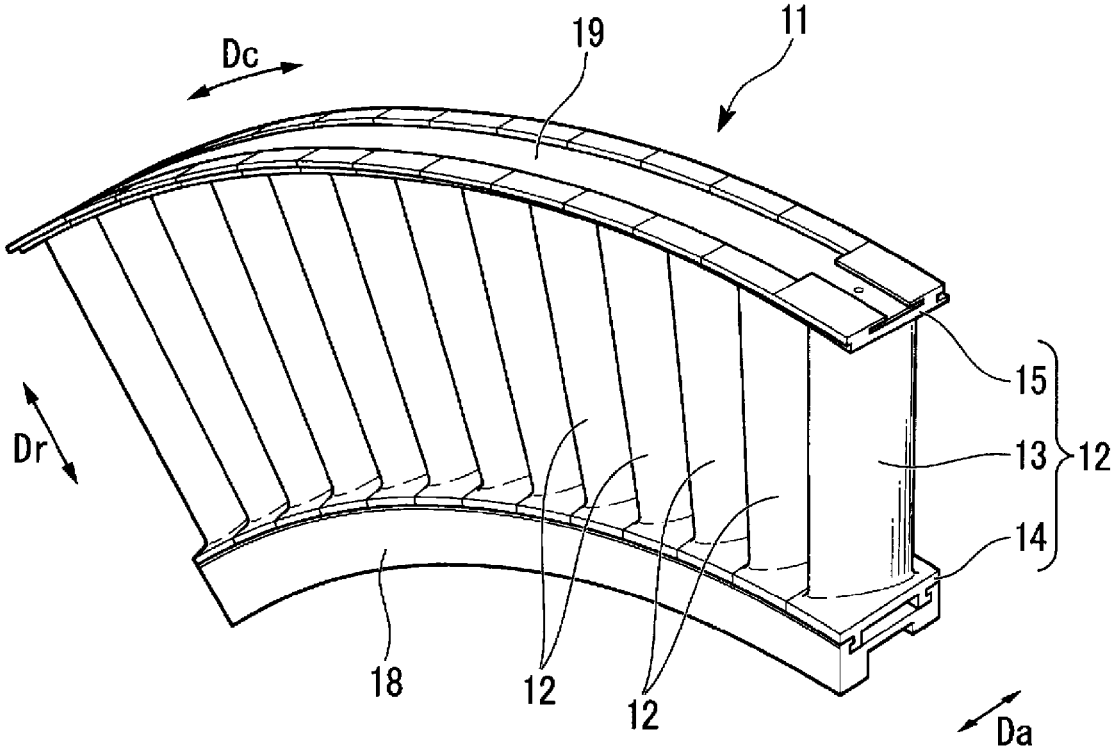
FIG. 4 is a perspective view of a vane segment in one embodiment according to the present invention.
Figure 5:
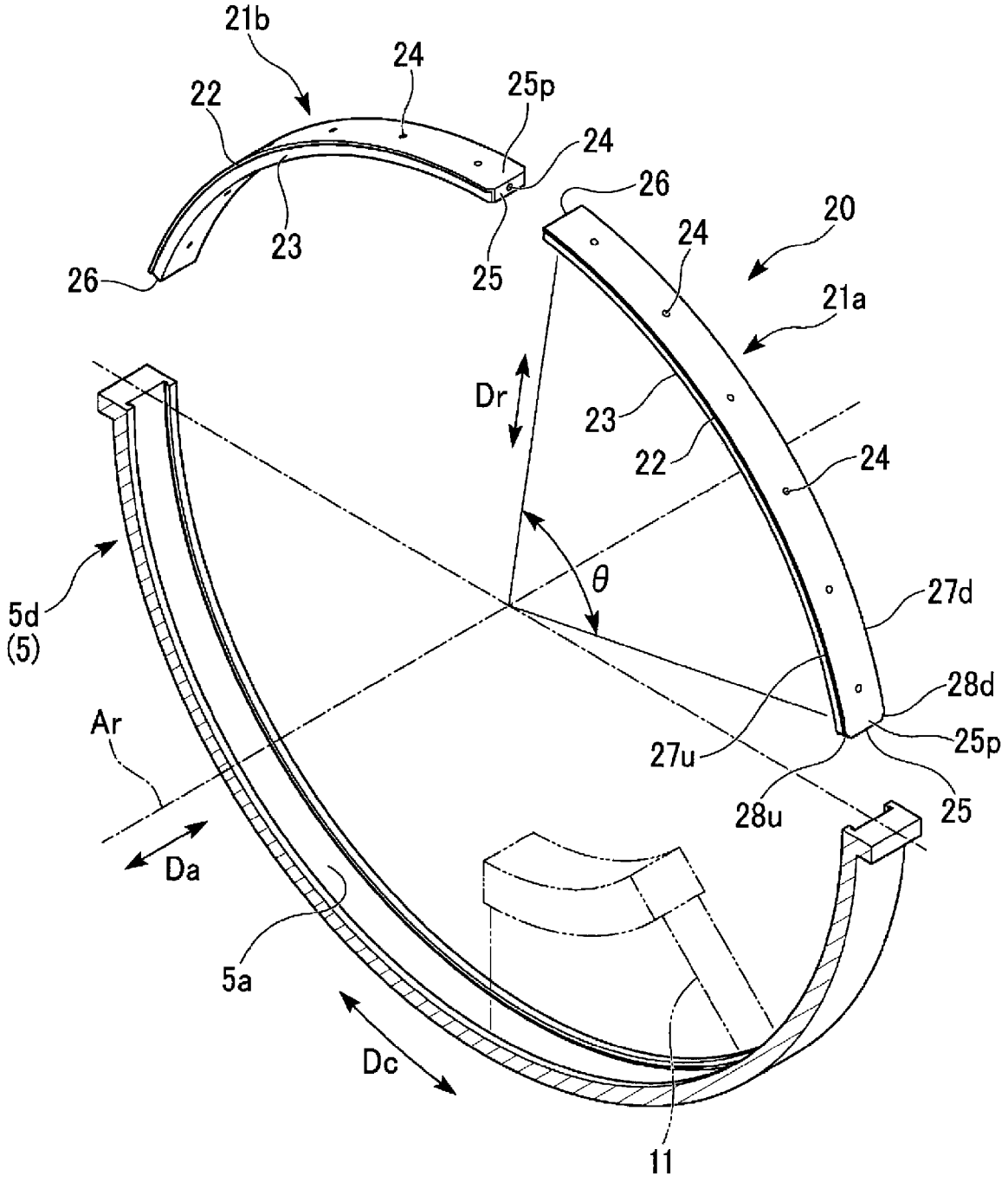
FIG. 5 is a perspective view of a dummy ring assembly for removal in a first embodiment according to the present invention.
Figure 6:
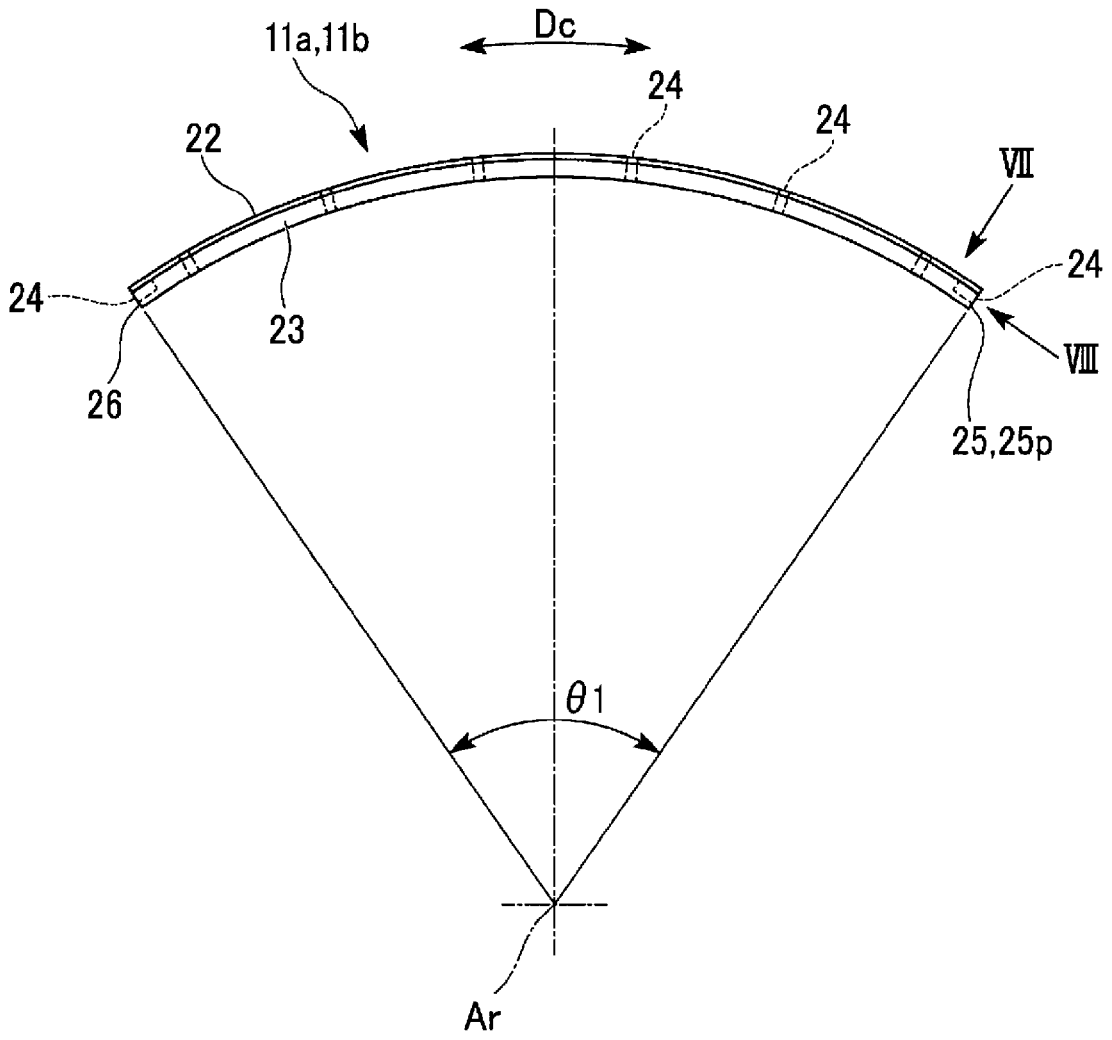
FIG. 6 is a front view of a dummy ring in the first embodiment according to the present invention.

As illustrated in FIG. 4, the vane segment 11 includes a plurality of vanes 12 arranged in the circumferential direction Dc, a linking holder 18 on which portions on the inner side in the radial direction of the plurality of vanes 12 are mounted, and a linking band 19 that links portions on the outer side in the radial direction of the plurality of vanes 12 to one another in the circumferential direction Dc.

Each of the vanes 12 includes a vane body 13 extending in the radial direction Dr, an inner shroud 14 provided on the inner side in the radial direction of the vane body 13, and an outer shroud 15 provided on the outer side in the radial direction of the vane body 13. A primary flow channel through which the compressed gas within the compressor casing 5 passes is formed between an outer circumferential side of the inner shroud 14 and an inner circumferential side of the outer shroud 15 of the vane 12. The inner shroud 14 of each of the plurality of vanes 12 is mounted on the linking holder 18, and the outer shroud 15 of each of the plurality of vanes 12 is mounted on the linking band 19. As illustrated in FIG. 2, of the constituent elements of the vane segments 11, the outer shrouds 15 of the plurality of vanes 12 are fitted into the vane ring groove 5*a* of the compressor casing 5.

Here, the plurality of vanes 12 are linked using the linking holder 18 and the linking band 19 to constitute a single vane segment 11; however, when linking the plurality of vanes 12, any linking method may be used.

First Embodiment of Dummy Ring Assembly for Removing Vane Segments and Method of Removing Vane Segments Using the Same The first embodiment of a dummy ring assembly for removing the above-described vane segments and a method of removing the vane segments using the same will be described using FIGS. 5 to 16.

As illustrated in FIGS. 5 to 8, a dummy ring assembly for removal 20 according to the present embodiment includes two dummy rings 21*a* and 21*b* that have an arc shape centered on the rotational axis Ar. The dummy rings 21*a* and 21*b* each include a dummy shroud section 22 that is configured to fit into the vane ring groove 5*a* of the compressor casing 5 and an inner circumferential side ring section 23 that projects toward the inner side in the radial direction from the dummy shroud section 22. A central angle θ1 of the arc-shaped dummy rings 21*a* and 21*b* is less than 90°, for example, 70°. The diameter of the outer circumferential surfaces of the dummy rings 21*a* and 21*b*, or in other words, the outer diameter of the dummy rings 21*a* and 21*b*, is substantially the same as the inner diameter of a groove bottom face of the vane ring groove 5*a*.

A plurality of thread holes (fitment attachment portions) 24 are formed in the dummy rings 21*a* and 21*b* to attach eye bolts (movement force application tools) used to apply a force for moving the dummy rings 21*a* and 21*b* in the circumferential direction Dc. The thread holes 24 are formed in both end surfaces of the dummy rings 21*a* and 21*b* in the circumferential direction Dc, or in other words, in a first end surface 25 and a second end surface 26. The thread holes 24 formed in the first end surface 25 and the second end surface 26 are recessed in the circumferential direction Dc. A plurality of the thread holes 24 are further formed in the outer circumferential surfaces of the dummy rings 21*a* and 21*b*, arranged in the circumferential direction Dc. The thread holes 24 formed in the outer circumferential surfaces are recessed toward the inner side in the radial direction. Note that an eye bolt is a bolt in which a threaded portion and a ring portion are integrated as a single bolt.

Figure 7:
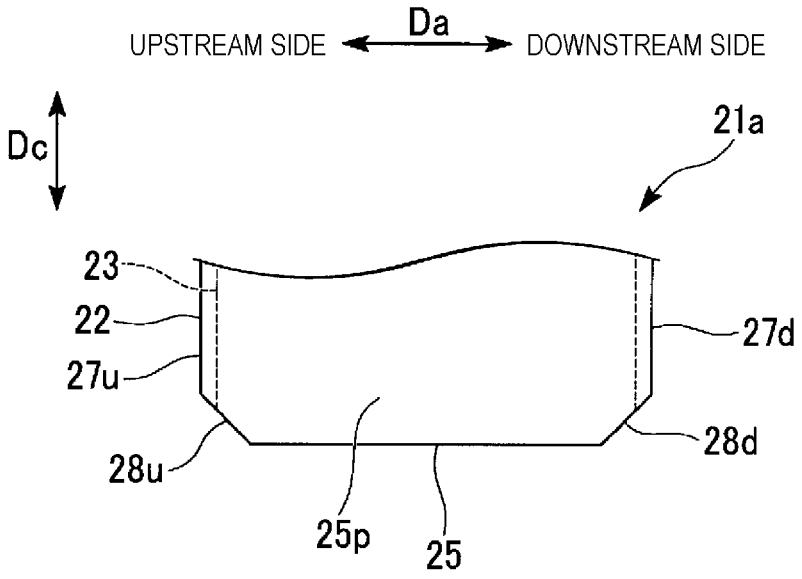
FIG. 7 is a diagram taken along an arrow VII in FIG. 6.

Tapered surfaces 28*u* and 28*d* are formed in a first end portion 25*p* that includes the first end surface 25, in at least the first dummy ring 21*a* of the two dummy rings 21*a* and 21*b*. As illustrated in FIG. 7, the tapered surfaces 28*u* and 28*d* are formed at corner portions located between the first end surface 25 of the first dummy ring 21*a* and a pair of side surfaces 27*u* and 27*d* that are the outer surface of the first dummy ring 21*a* and oriented in the axial direction Da. Of the pair of side surfaces 27*u* and 27*d*, the upstream side tapered surface 28*u* formed at the corner portion between the side surface 27*u* located on the upstream side in the axial direction Da and the first end surface 25 is sloped so as to gradually extend toward the upstream side as the tapered surface 28*u* extends from the first end surface 25 toward the second end surface 26 in the circumferential direction Dc. Meanwhile, the downstream side tapered surface 28*d* formed at the corner portion between the side surface 27*d* located on the downstream side in the axial direction Da and the first end surface 25 is sloped so as to gradually extend toward the downstream side as the tapered surface 28*d* extends from the first end surface 25 toward the second end surface 26 in the circumferential direction Dc. Accordingly, the width of the first end portion 25*p* of the first dummy ring 21*a* in the axial direction Da gradually increases as the first dummy ring 21*a* extends from the first end surface 25 toward the second end surface 26 in the circumferential direction Dc.

Figure 8:
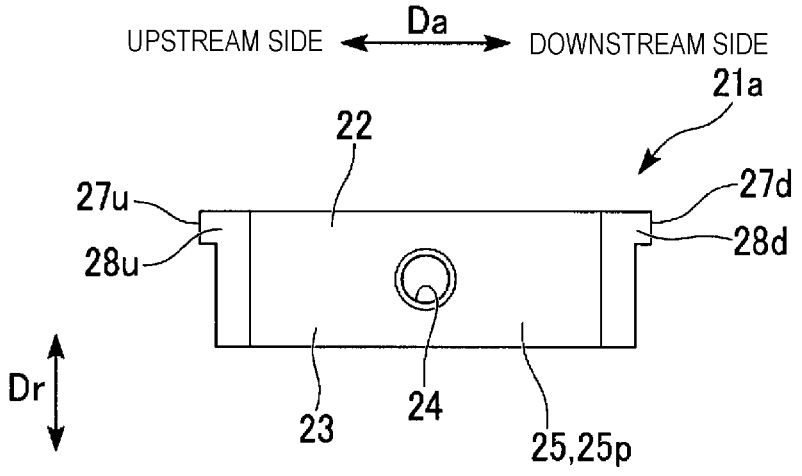
FIG. 8 is a diagram taken along an arrow VIII in FIG. 6.

As illustrated in FIGS. 7 and 8, the tapered surfaces 28*u* and 28*d* are formed across both the dummy shroud section 22 and the inner circumferential side ring section 23 in the first end portion 25*p* of the first dummy ring 21*a*. The tapered surfaces 28*u* and 28*d* are provided to increase the ease with which the dummy shroud section 22 of the first dummy ring 21*a* can be inserted into the vane ring groove 5*a* of the compressor casing 5 from the first end portion 25*p* side. It is therefore sufficient for the tapered surfaces 28*u* and 28*d* to be formed in at least the dummy shroud section 22 at the first end portion 25*p* of the first dummy ring 21*a*.

In the present embodiment, the dummy rings 21*a* and 21*b* are formed from an aluminum alloy. To manufacture the dummy rings 21*a* and 21*b*, first, a straight line-shaped member having parts corresponding to the dummy shroud section 22 and the inner circumferential side ring section 23 is formed. Next, the straight line-shaped member is subjected to a roll bending process and formed into an arc-shaped member. The arc-shaped member is then subjected to a process of forming the thread holes 24 and the like, thus completing the dummy rings 21*a* and 21*b*.

Next, a procedure for removing vane segments using the above-described dummy ring assembly for removal 20 will be described using FIGS. 9 to 14.

Figure 9:
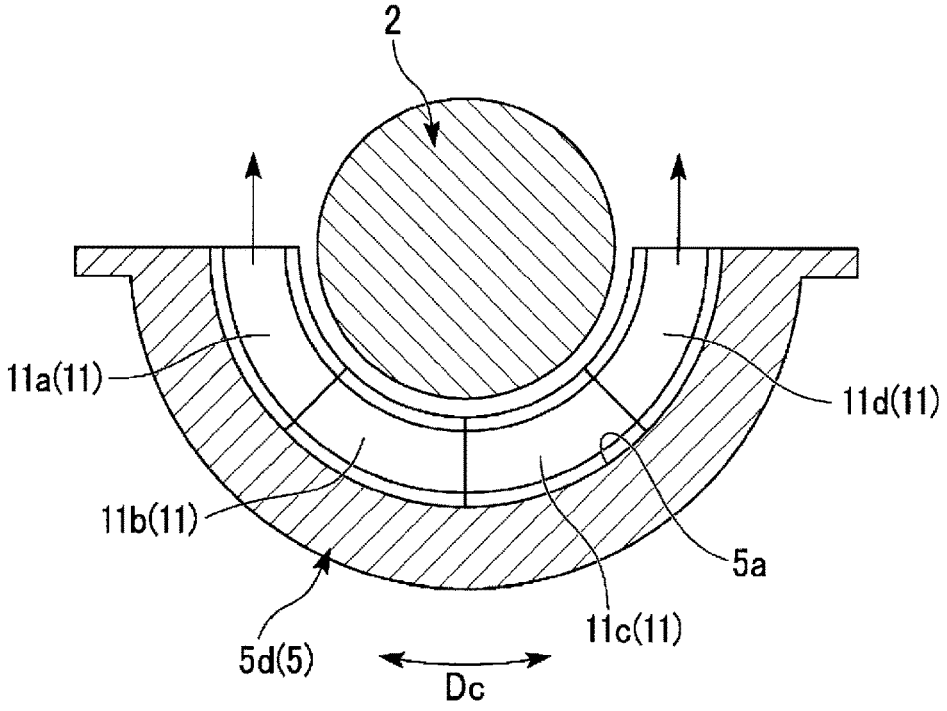
FIG. 9 is an explanatory diagram (No. 1) illustrating a procedure for removing vane segments in the first embodiment according to the present invention.

First, as illustrated in FIG. 9, the compressor casing 5 illustrated in FIG. 3 is disassembled, and the upper casing 5*u* is removed. At this point in time, the compressor rotor 2 is supported on a bearing (not illustrated) provided in the lower casing 5*d*. Meanwhile, four vane segments 11, of the eight vane segments 11 that constitute the vane ring 10, are mounted in the lower casing 5*d*. Here, to facilitate the following descriptions, of the four vane segments 11 that form a semicircular-arc shape as a whole, the vane segment 11 located at the end on one side in the circumferential direction Dc will be referred to as a first vane segment 11*a*, the vane segment 11 adjacent to the first vane segment 11*a* on the other side in the circumferential direction Dc as a second vane segment 11*b*, the vane segment 11 adjacent to the second vane segment 11*b* on the other side in the circumferential direction Dc as a third vane segment 11*c*, and the vane segment 11 adjacent to the third vane segment 11*c* on the other side in the circumferential direction Dc as a fourth vane segment 11*d*.

Next, of the four vane segments 11 that form a semicircular-arc shape as a whole, the first vane segment 11*a* and the fourth vane segment 11*d*, which are the vane segments 11 located on the respective ends in the circumferential direction Dc, are moved in the circumferential direction Dc and pulled out from the lower casing 5*d*. The vane segments 11 are pulled out, for example, by a worker gripping the vane segments 11 directly and pulling the segments out by his/her own strength. The vane segments 11 may be pulled out using a chain block, for example. Specifically, of the plurality of vanes 12 that constitute the vane segments 11, a band or the like is wrapped about the vane body 13 of the vane 12 located at an end in the circumferential direction Dc. One end of a chain extending from the chain block is attached to this band or the like. The vane segment 11 is then pulled out from the lower casing 5*d* by operating the chain block.

Figure 10:
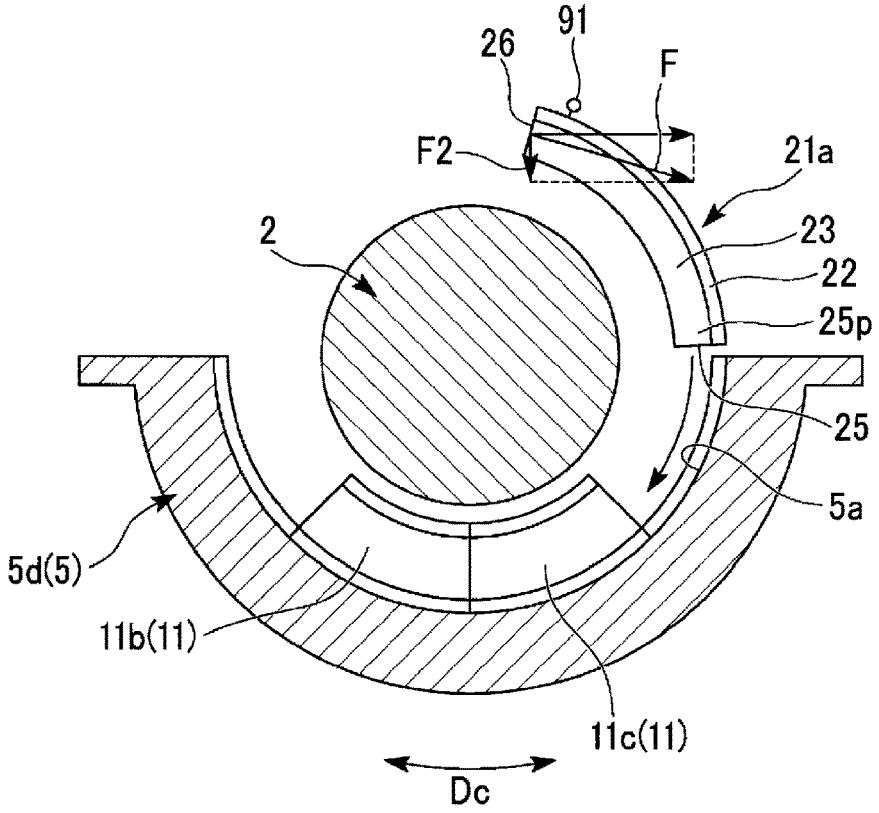
FIG. 10 is an explanatory diagram (No. 2) illustrating the procedure for removing vane segments in the first embodiment according to the present invention.

Next, as illustrated in FIG. 10, the first dummy ring 21*a* is placed upon the lower casing 5*d*. At this time, the dummy shroud section 22 at the first end portion 25*p* of the first dummy ring 21*a* is made to face an opening at the end of the vane ring groove 5*a* of the lower casing 5*d* in the circumferential direction Dc. The dummy shroud section 22 of the first dummy ring 21*a* is then inserted into the vane ring groove 5*a* of the lower casing 5*d* starting with the first end portion 25*p* side thereof. As described above, the tapered surfaces 28*u* and 28*d* are formed in the first end portion 25*p* of the first dummy ring 21*a*, and thus the dummy shroud section 22 can be inserted into the vane ring groove 5*a* with ease.

Figure 11:
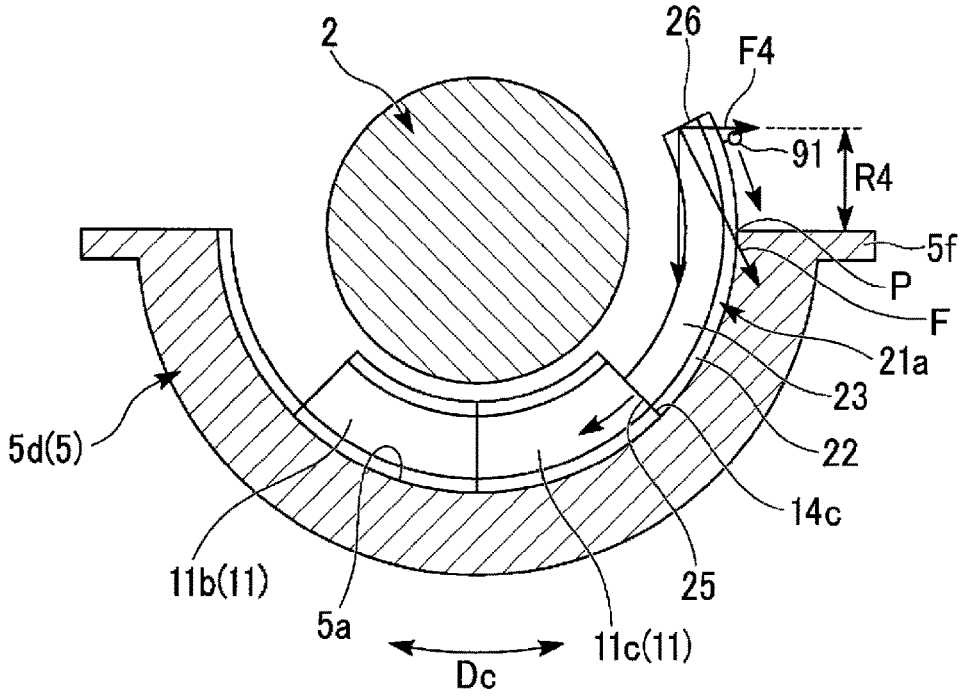
FIG. 11 is an explanatory diagram (No. 3) illustrating the procedure for removing vane segments in the first embodiment according to the present invention.

After the first end portion 25*p* of the dummy shroud section 22 of the first dummy ring 21*a* has been inserted into the vane ring groove 5*a*, the first dummy ring 21*a* is moved along the vane ring groove 5*a* in the circumferential direction Dc (a first movement step). As illustrated in FIG. 11, upon the first dummy ring 21*a* being moved in the circumferential direction Dc, the first end surface 25 of the first dummy ring 21*a* makes contact with an end surface 14*c* in the circumferential direction Dc of the third vane segment 11*c* that remains within the lower casing 5*d*. Then, upon the first dummy ring 21*a* being moved further in the circumferential direction Dc while the first end surface 25 of the first dummy ring 21*a* is in contact with the end surface 14*c* in the circumferential direction Dc of the third vane segment 11*c*, the third vane segment 11*c* and the second vane segment 11*b* also move in the circumferential direction Dc in response to the first dummy ring 21*a* moving in the circumferential direction Dc. At this time, a chain block, for example, is used in the case where friction between the third and second vane segments 11*c* and 11*b* and the lower casing 5*d* makes it difficult to manually move the first dummy ring 21*a* in the circumferential direction Dc. When using a chain block in this manner, first, an eye bolt 91 is screwed into a thread hole 24, of the thread holes 24 formed in the outer circumferential surface of the first dummy ring 21*a*, that does not face the groove bottom face of the vane ring groove 5*a* of the lower casing 5*d*, or in other words, a thread hole 24 that is exposed from the lower casing 5*d*. Next, an end portion of a first chain extending from the chain block is attached to a flange 5*f* of the lower casing 5*d* or at a position below the lower casing 5*d*. Next, an end portion of a second chain extending from the chain block is attached to the ring portion of the eye bolt 91. The first dummy ring 21*a* is then moved in the circumferential direction Dc by operating the chain block.

Figure 12:
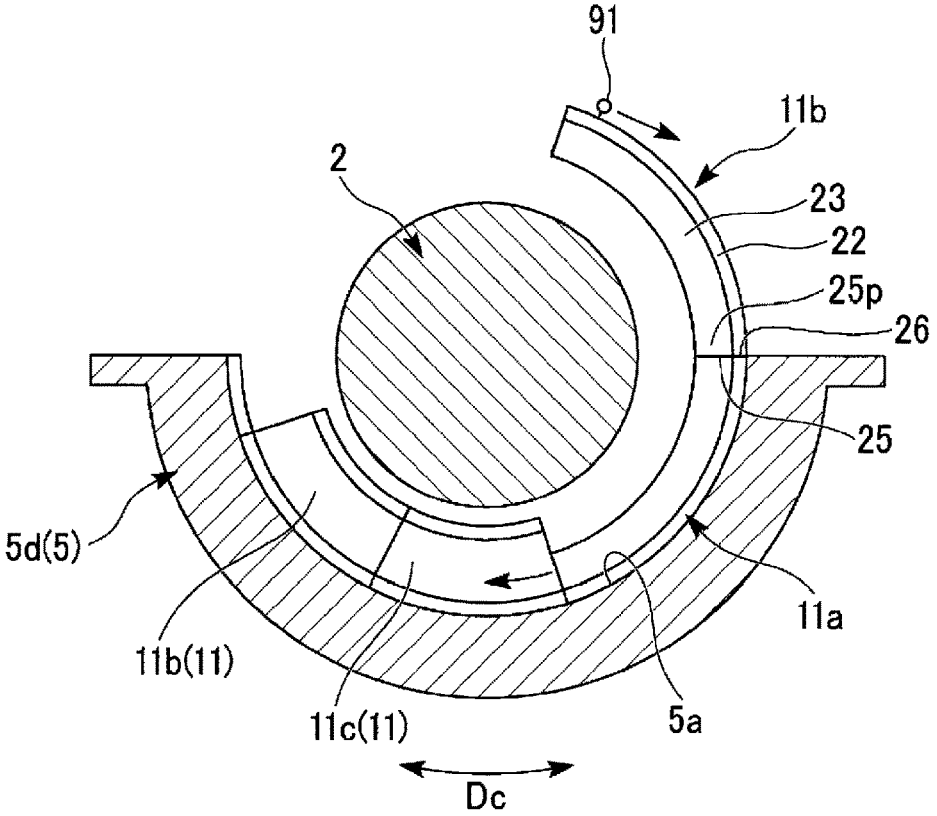
FIG. 12 is an explanatory diagram (No. 4) illustrating the procedure for removing vane segments in the first embodiment according to the present invention.

As illustrated in FIG. 12, upon the entire dummy shroud section 22 of the first dummy ring 21*a* in the circumferential direction Dc entering into the vane ring groove 5*a* of the lower casing 5*d*, the second dummy ring 21*b* is placed upon the lower casing 5*d*. At this time, too, like when the first dummy ring 21*a* is placed on the lower casing 5*d*, the dummy shroud section 22 at the first end portion 25*p* of the second dummy ring 21*b* is made to face the opening at the end of the vane ring groove 5*a* of the lower casing 5*d* in the circumferential direction Dc. The dummy shroud section 22 of the second dummy ring 21*b* is then inserted into the vane ring groove 5*a* of the lower casing 5*d* starting with the first end portion 25*p* side thereof, and the second dummy ring 21*b* is moved along the vane ring groove 5*a* in the circumferential direction Dc (a second movement step).

Figure 13:
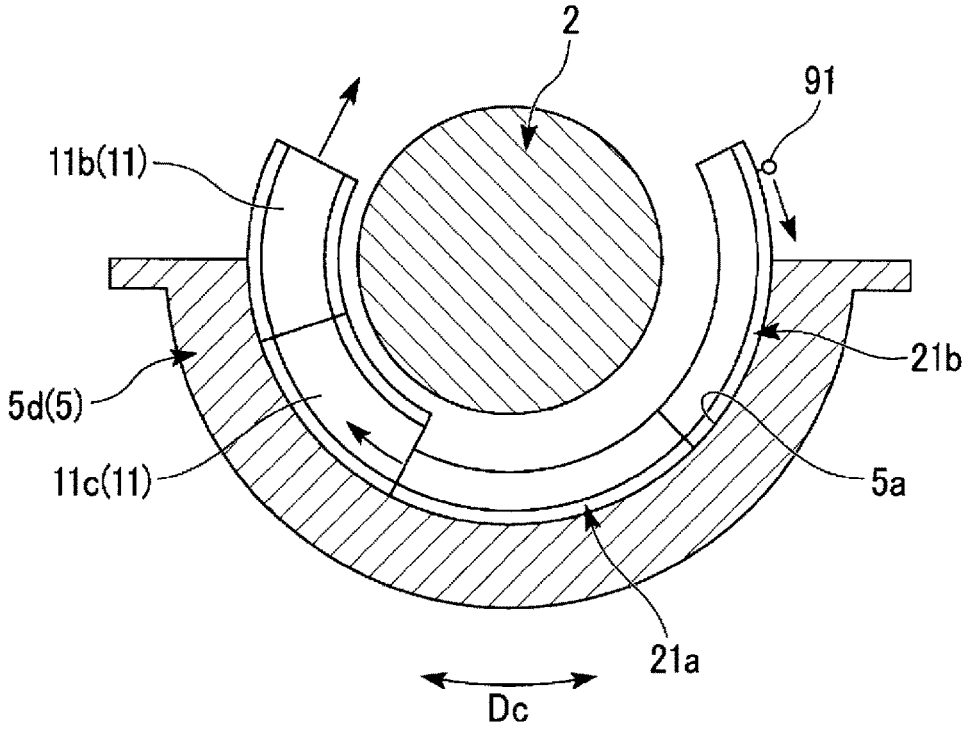
FIG. 13 is an explanatory diagram (No. 5) illustrating the procedure for removing vane segments in the first embodiment according to the present invention.

As illustrated in FIG. 13, when the second dummy ring 21*b* is moved in the circumferential direction Dc, the first dummy ring 21*a*, the third vane segment 11*c*, and the second vane segment 11*b* also move in the circumferential direction Dc in response to the second dummy ring 21*b* moving in the circumferential direction Dc. At this time, a chain block is used in the case where it is difficult to manually move the second dummy ring 21*b* in the circumferential direction Dc, in the same manner as when moving the first dummy ring 21*a* as described above.

The movement of the third vane segment 11*c* and the second vane segment 11*b* in the circumferential direction Dc in response to the second dummy ring 21*b* moving in the circumferential direction Dc causes an end portion of the second vane segment 11*b* in the circumferential direction Dc to protrude from the lower casing 5*d* in the circumferential direction Dc, as illustrated in FIG. 13. Upon the end portion of the second vane segment 11*b* in the circumferential direction Dc protruding from the lower casing 5*d* in the circumferential direction Dc, the second vane segment 11*b* is pulled out from the lower casing 5*d* (a segment pullout step).

Figure 14:
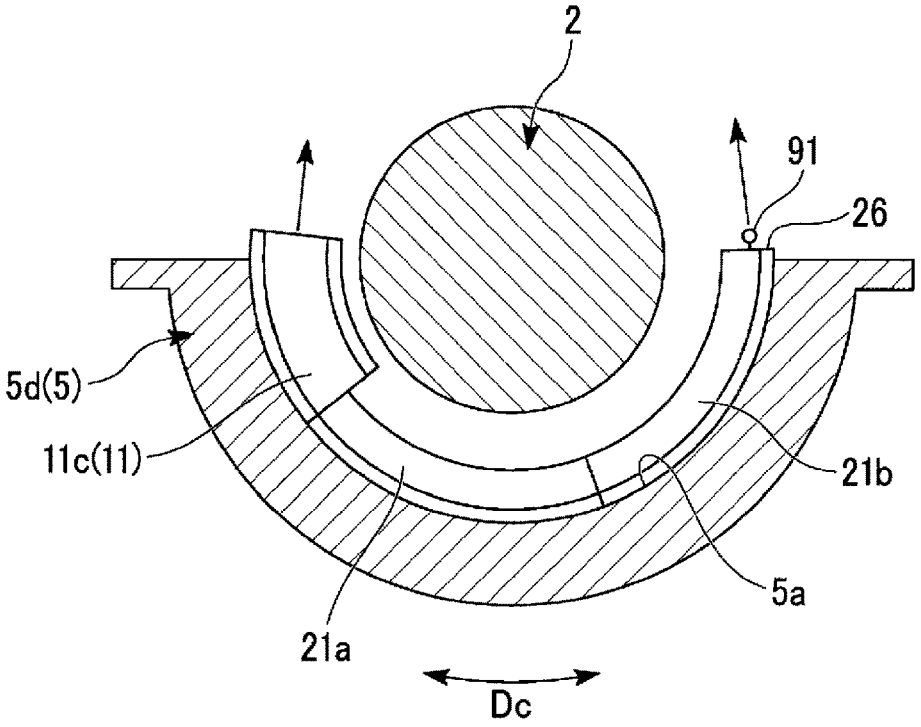
FIG. 14 is an explanatory diagram (No. 6) illustrating the procedure for removing vane segments in the first embodiment according to the present invention.

The central angle of the semi-cylindrical lower casing 5*d* is 180°. Meanwhile, the total of the central angles of the two dummy rings 21*a* and 21*b* is 140° (=70°×2). The central angle of a single vane segment 11 is 45°. In other words, the total of the central angles of the two dummy rings 21*a* and 21*b* (140°) is greater than an angle (that is, 135°) obtained by subtracting the central angle of a single vane segment 11 (45°) from the central angle of the lower casing 5*d* (180°). Accordingly, as illustrated in FIG. 14, once the two dummy rings 21*a* and 21*b* are entirely within the lower casing 5*d* in the circumferential direction Dc, the central angle of a region in the semi-cylindrical lower casing 5*d* that is not occupied by the two dummy rings 21*a* and 21*b* is 40° (=180°−140°). As such, a single vane segment 11 cannot be completely contained within the lower casing 5*d* in the circumferential direction Dc while the two dummy rings 21*a* and 21*b* are entirely within the lower casing 5*d* in the circumferential direction Dc. The end portion of the third vane segment 11*c* in the circumferential direction Dc protrudes from the lower casing 5*d* in the circumferential direction Dc in a state where the second dummy ring 21*b* has been moved in the circumferential direction Dc and the two dummy rings 21*a* and 21*b* are almost entirely within the lower casing 5*d* in the circumferential direction Dc, as illustrated in FIG. 14. Upon the end portion of the third vane segment 11*c* in the circumferential direction Dc protruding from the lower casing 5*d* in the circumferential direction Dc, the third vane segment 11*c* is pulled out from the lower casing 5*d* (a segment pullout step).

All of the vane segments 11 in the vane ring groove 5*a* of the lower casing 5*d* are thus removed from the lower casing 5*d*.

Of the two dummy rings 21*a* and 21*b* remaining within the lower casing 5*d*, the second dummy ring 21*b* is pulled out from the lower casing 5*d*. At this time, the eye bolt 91 is screwed into the thread hole 24 formed in the second end surface 26 of the second dummy ring 21*b*, and the second dummy ring 21*b* is pulled out from the lower casing 5*d* by applying a force to the ring portion of the eye bolt 91 in a pullout direction. Note that at this time, the end portion of a chain extending from a chain block may be attached to the ring portion of the eye bolt 91 and the second dummy ring 21*b* may be pulled out by operating the chain block.

On the other hand, of the two dummy rings 21*a* and 21*b* remaining within the lower casing 5*d*, the first dummy ring 21*a* remains within the lower casing 5*d* even while the vane segments 11 removed from the lower casing 5*d* are in repair or the like. The first dummy ring 21*a* is pushed out from the lower casing 5*d* by the vane segments 11 during the process of attaching the repaired plurality of vane segments 11 to the lower casing 5*d* in order.

The plurality of vane segments 11 within the upper casing 5*u* illustrated in FIG. 3 are removed from the upper casing 5*u* without using the above-described dummy ring assembly for removal 20. The compressor rotor 2 is not present on the inner circumferential side of the plurality of vane segments 11 within the upper casing 5*u* after the compressor casing 5 has been disassembled. All of the plurality of vane segments 11 within the upper casing 5*u* can therefore be accessed directly without interference from the compressor rotor 2. Accordingly, the plurality of vane segments 11 within the upper casing 5*u* are removed from the upper casing 5*u* by hand, or using a chain block or the like as necessary, without using the above-described dummy ring assembly for removal 20.

As described thus far, according to the present embodiment, the plurality of vane segments 11 within the lower casing 5*d* are pushed out from the lower casing 5*d* by attaching the two dummy rings 21*a* and 21*b* to the lower casing 5*d* and moving the two dummy rings 21*a* and 21*b* in the circumferential direction Dc. As such, according to the present embodiment, the plurality of vane segments 11 can be removed from the lower casing 5*d* even in a state where the compressor rotor 2 is supported by the lower casing 5*d* through a bearing. The duration of work for removing the vane segments can be shortened as a result.

As described in the Background Art section, the method disclosed in Patent Document 1 requires that a roll cage assembly and a dummy section having a semicircular-arc shape (central angle: 180°) and a long arc length be prepared. Meanwhile, it is extremely difficult to precisely manufacture an arc-shaped member having a central angle of 180° through a rolling process. It is thus expensive to precisely manufacture an arc-shaped member having a central angle of 180°. On the other hand, according to the present embodiment, preparing the two arc-shaped dummy rings 21*a* and 21*b*, whose central angles are less than 90°, is sufficient. Furthermore, the dummy rings 21*a* and 21*b* are formed from an aluminum alloy in the present embodiment, and can thus be processed through a rolling process with ease. The cost of removing the vane segments 11 can therefore be suppressed according to the present embodiment.

Incidentally, in the present embodiment, reducing the cost as described above is not the only reason the central angle of each of the arc-shaped dummy rings 21*a* and 21*b* is set to be less than 90°.

According to the method disclosed in Patent Document 1, both ends in the circumferential direction Dc of the semi-circular-arc-shaped dummy section, whose central angle is 180°, are connected to the vane segments fitted into the vane ring groove of the lower casing, and the dummy section and plurality of vane segments form a single ring as a result. This ring is then rotated in the circumferential direction Dc. As such, according to the method disclosed in Patent Document 1, the plurality of vane segments mounted in the vane ring groove of the lower casing and the dummy section form a single ring, and thus it is necessary that the central angle of the dummy section be 180°. However, as described above, the central angle of the dummy ring will be less than 180° in the case where one of the end surfaces of the dummy ring is brought into contact with only the end surface 14*c* of one of the plurality of vane segments 11 mounted in the lower casing 5*d* in order to remove the plurality of vane segments 11 from the lower casing 5*d*.

Figure 15:
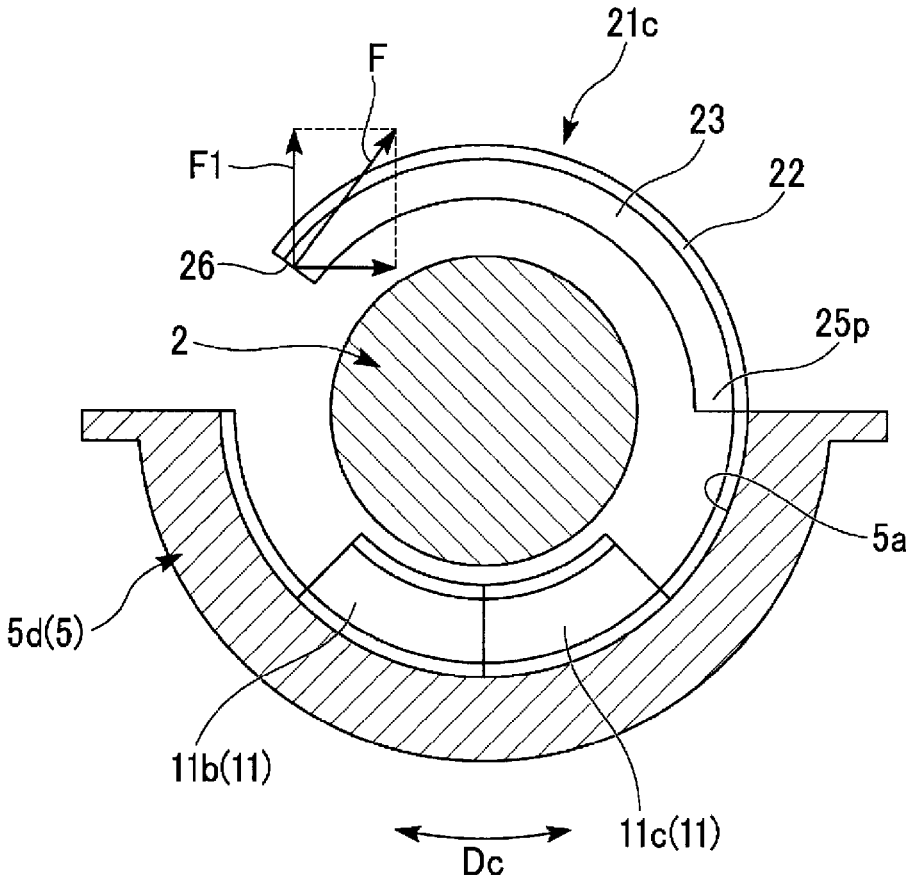
FIG. 15 is an explanatory diagram (No. 1) illustrating a procedure for removing vane segments in a comparative example of the first embodiment according to the present invention.
Figure 16:
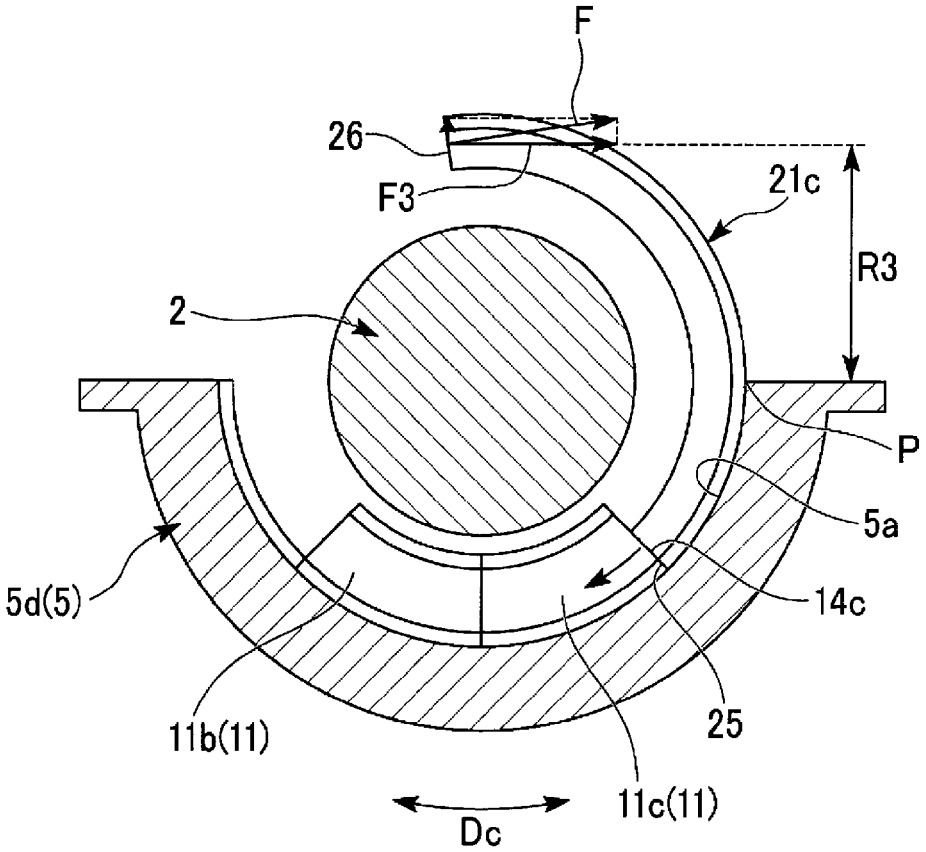
FIG. 16 is an explanatory diagram (No. 2) illustrating the procedure for removing vane segments in the comparative example of the first embodiment according to the present invention.

Now, as a comparative example, a case of using a dummy ring 21*c* whose central angle is greater than or equal to 90° and less than 180° will be examined, as illustrated in FIGS. 15 and 16.

As in the embodiment described above, in this case also, the dummy ring 21*c* is placed on the lower casing 5*d*, and the dummy shroud section 22 at the first end portion 25*p* of the dummy ring 21*c* is made to face the opening at the end of the vane ring groove 5*a* of the lower casing 5*d* in the circumferential direction Dc. The dummy shroud section 22 of the dummy ring 21*c* is then inserted into the vane ring groove 5*a* of the lower casing 5*d* starting with the first end portion 25*p* side thereof. Assume that a force F perpendicular to the second end surface 26 of the dummy ring 21*c* is then applied in order to move the dummy ring 21*c* in the circumferential direction Dc. A vertical direction force component F1 of the force F is oriented vertically upward. In light of this, unless the first end surface 25 of the dummy ring 21*c* moves downward, the dummy ring 21*c* will not move along the vane ring groove 5*a*. Accordingly, the dummy ring 21*c* according to the comparative example cannot be moved along the vane ring groove 5*a* simply by applying the force F perpendicular to the second end surface 26 of the dummy ring 21*c*. It is therefore necessary, for example, to apply some kind of force to the first end portion 25*p* of the dummy ring 21*c* according to the comparative example in addition to the force F perpendicular to the second end surface 26 of the dummy ring 21*c*. Thus according to the dummy ring 21*c* of the comparative example, the operations for moving the dummy ring 21*c* along the vane ring groove 5*a* after the dummy shroud section 22 at the first end portion 25*p* of the dummy ring 21*c* has been inserted into the vane ring groove 5*a* of the lower casing 5*d* are troublesome.

It is assumed in the present embodiment as well that the perpendicular force F is applied to the second end surface 26 of the first dummy ring 21*a* according to the present embodiment after the dummy shroud section 22 at the first end portion 25*p* of the first dummy ring 21*a* has been inserted into the vane ring groove 5*a* of the lower casing 5*d*, as illustrated in FIG. 10. The central angle of the dummy rings 21*a* and 21*b* is in the present embodiment 70°, which is less than 90°. Accordingly, a vertical direction force component F2 of the force F at this time is oriented vertically downward. As such, the direction of the force component F2 matches the direction in which it is necessary for the first end portion 25*p* of the first dummy ring 21*a* to move. As such, according to the dummy rings 21*a* and 21*b* of the present embodiment, after the dummy shroud section 22 at the first end portion 25*p* of the dummy rings 21*a* and 21*b* has been inserted into the vane ring groove 5*a* of the lower casing 5*d*, it is easy to move the dummy rings 21*a* and 21*b* along the vane ring groove 5*a*.

Assume, as illustrated in FIG. 16, that the perpendicular force F is applied to the second end surface 26 of the dummy ring 21*c* of the comparative example even after the first end surface 25 of the dummy ring 21*c* has made contact with the end surface 14*c* of the vane segment 11 mounted in the lower casing 5*d*. It is necessary to move the vane segments 11 mounted in the lower casing 5*d* along with the dummy ring 21*c* after the first end surface 25 of the dummy ring 21*c* has made contact with the end surface 14*c* of the vane segment 11 mounted in the lower casing 5*d*, and it is therefore necessary to apply a greater force to the second end surface 26 of the dummy ring 21*c*.

In the comparative example, when the force F is applied to the second end surface 26 of the dummy ring 21*c*, the bending moment applied to a position P in the outer circumferential surface of the dummy ring 21*c* that makes contact with the end of the lower casing 5*d* in the circumferential direction Dc (called an "end contact position" hereinafter) has a value obtained by multiplying a horizontal direction force component F3 of the force F by a distance R3 from the end contact position P to a line of action of the force component F3.

In the present embodiment as well, assume that the perpendicular force F is applied to the second end surface 26 of the first dummy ring 21*a* even after the first end surface 25 of the first dummy ring 21*a* has made contact with the end surface 14*c* of the vane segment 11 mounted in the lower casing 5*d*, as illustrated in FIG. 11. When the force F is applied to the second end surface 26 of the first dummy ring 21*a*, the bending moment applied to the end contact position P in the outer circumferential surface of the first dummy ring 21*a* that makes contact with the end of the lower casing 5*d* in the circumferential direction Dc also has a value obtained by multiplying a horizontal direction force component F4 of the force F by a distance R4 from the end contact position P to a line of action of the force component F4.

The central angle of the dummy ring 21*c* in the comparative example is greater than or equal to 90°, which is greater than the central angle of the dummy rings 21*a* and 21*b* according to the present embodiment. As such, according to the dummy ring 21*c* of the comparative example, the horizontal direction force component F3 of the force F applied to the second end surface 26 at the point in time when the first end surface 25 makes contact with the end surface 14*c* of the vane segment 11 mounted in the lower casing 5*d* is greater than the force component F4 in the case where the dummy rings 21*a* and 21*b* according to the present embodiment are used. Furthermore, according to the dummy ring 21*c* of the comparative example, the distance R3 from the end contact position P to the line of action of the horizontal direction force component F3 of the force F applied to the second end surface 26 is greater than the distance R4 in the case where the dummy rings 21*a* and 21*b* according to the present embodiment are used at the same point in time. As such, the bending moment applied to the end contact position P is much greater with the dummy ring 21*c* according to the comparative example than in the case where the dummy rings 21*a* and 21*b* according to the present embodiment are used. As such, according to the comparative example, a bend level of the dummy ring 21*c* relative to the end contact position P increases, and it becomes difficult to move the dummy ring 21*c* along the vane ring groove 5*a* of the lower casing 5*d*.

Conversely, the bending moment applied to the end contact position P is much smaller with the dummy rings 21*a* and 21*b* according to the present embodiment than in the case where the dummy ring 21*c* according to the comparative example is used. As such, according to the present embodiment, the bend level of the dummy rings 21*a* and 21*b* relative to the end contact position P is reduced, and the dummy rings 21*a* and 21*b* can be moved along the vane ring groove 5*a* of the lower casing 5*d* with ease.

As described thus far, in the present embodiment, the central angle of each of the arc-shaped dummy rings 21*a* and 21*b* is set to less than 90° for reasons related to the ease of moving the dummy rings 21*a* and 21*b* along the vane ring groove 5*a* as well.

Accordingly, setting the central angle of each of the arc-shaped dummy rings 21*a* and 21*b* to less than 90° not only makes it possible to suppress the cost of removing the vane segments 11 but also makes it possible to increase the ease of moving the dummy rings 21*a* and 21*b*.

However, if the central angle of each of the arc-shaped dummy rings 21*a* and 21*b* is set to be extremely small, many dummy rings will be necessary, increasing the amount of labor involved in inserting the dummy shroud sections of the dummy rings into the vane Ting groove 5*a* of the lower casing 5*d*. It is therefore preferable that the central angle of each dummy ring be less than 90° and greater than or equal to 45°. In the case where, for example, vane segments 11 having a central angle of 45° are removed from the lower casing 5*d* using dummy rings having a central angle of 50°, three dummy rings are needed.

First Modification of First Embodiment

A first modification of the dummy ring assembly for removal according to the first embodiment will be described using FIG. 17.

The two tapered surfaces 28*u* and 28*d* are formed in the first end portion 25*p* of the first dummy ring 21*a* of the dummy ring assembly for removal 20 according to the first embodiment. The tapered surfaces 28*u* and 28*d* have the same angle relative to the circumferential direction Dc.

As in the first embodiment, two tapered surfaces 28*ud* and 28*dd* are formed in the first end portion 25*p* of a first dummy ring 21*d* of a dummy ring assembly for removal according to this modification. However, in this modification, angles α and β of the tapered surfaces 28*ud* and 28*dd* relative to the circumferential direction Dc are different from each other.

Figure 17:
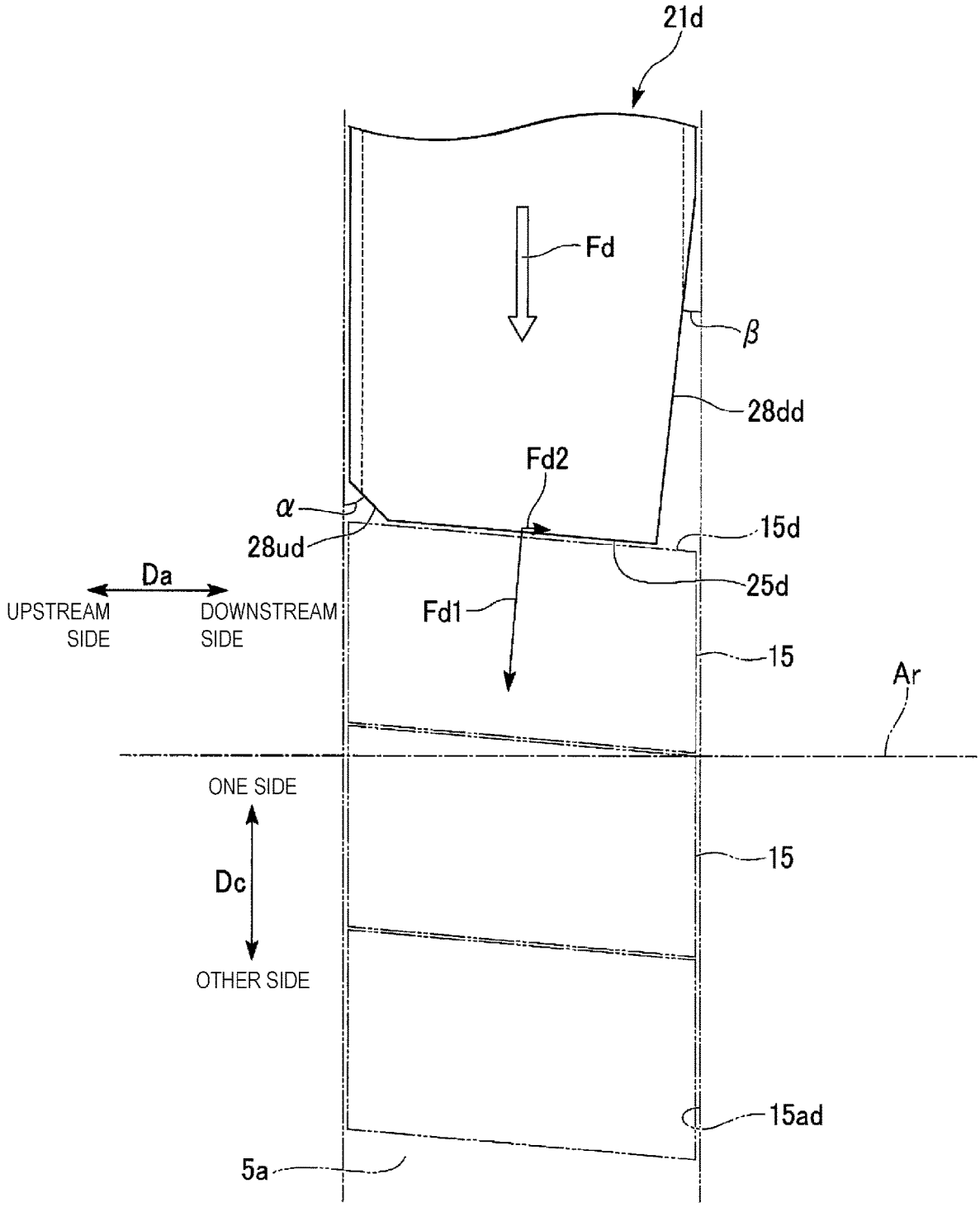
FIG. 17 is a diagram illustrating a circumferential direction end portion of a first dummy ring in a first modification of the first embodiment according to the present invention.

As illustrated in FIG. 17, in the outer shrouds 15 of the plurality of vanes that constitute a vane segment, end surfaces 15*d* in the circumferential direction Dc may be slanted relative to the rotational axis Ar so as to gradually extend from one side in the circumferential direction Dc toward the other side in the circumferential direction Dc as the outer shroud 15 extends from the upstream side in the axial direction Da toward the downstream side in the axial direction Da.

In this case, a first end surface 25*d* of the first dummy ring 21*d* is also slanted in the same manner as the end surfaces 15*d* of the outer shrouds 15 in the circumferential direction Dc. Specifically, the first end surface 25*d* of the first dummy ring 21*d* is slanted so as to gradually extend from one side in the circumferential direction Dc toward the other side in the circumferential direction Dc as the first end surface 25*d* extends from the upstream side in the axial direction Da toward the downstream side in the axial direction Da.

In this case, a force Fd that moves the first dummy ring 21*d* from one side in the circumferential direction Dc toward the other side in the circumferential direction Dc can, at the part of the first dummy ring 21*d* that makes contact with the end surface 15*d* of the outer shroud 15, be expressed as a first force component Fd1 acting in a direction perpendicular to the end surface 15*d* of the outer shroud 15 and a second force component Fd2 acting in a direction parallel to the end surface 15*d* of the outer shroud 15. The second force component Fd2 is a force that attempts to push the first end portion 25*p* of the first dummy ring 21*d* toward the downstream side. In other words, the second force component Fd2 is a force that attempts to bring the first end portion 25*p* of the first dummy ring 21*d* into contact with a downstream side groove side surface 5*ad* of the vane ring groove 5*a* extending in the circumferential direction Dc, thus inhibiting the movement of the first dummy ring 21*d* in the circumferential direction Dc.

Accordingly, in this modification, the angle β of the downstream side tapered surface 28*dd* of the first dummy ring 21*d* relative to the circumferential direction Dc is set to be smaller than the angle α of the upstream side tapered surface 28*ud* of the first dummy ring 21*d* relative to the circumferential direction Dc. As a result, according to this modification, the first dummy ring 21*d* can move smoothly in the circumferential direction Dc even when a force is acting so as to push the first end portion 25*p* of the first dummy ring 21*d* toward the downstream side.

Although the foregoing describes a case where the first dummy ring 21*d* is moved from one side in the circumferential direction Dc toward the other side in the circumferential direction Dc as an example, the angle α of the upstream side tapered surface 28*ud* of the first dummy ring 21*d* relative to the circumferential direction Dc is reduced in the case where the first dummy ring 21*d* is to be moved from the other side in the circumferential direction Dc toward the one side in the circumferential direction Dc.

Second Modification of First Embodiment

Figure 18:
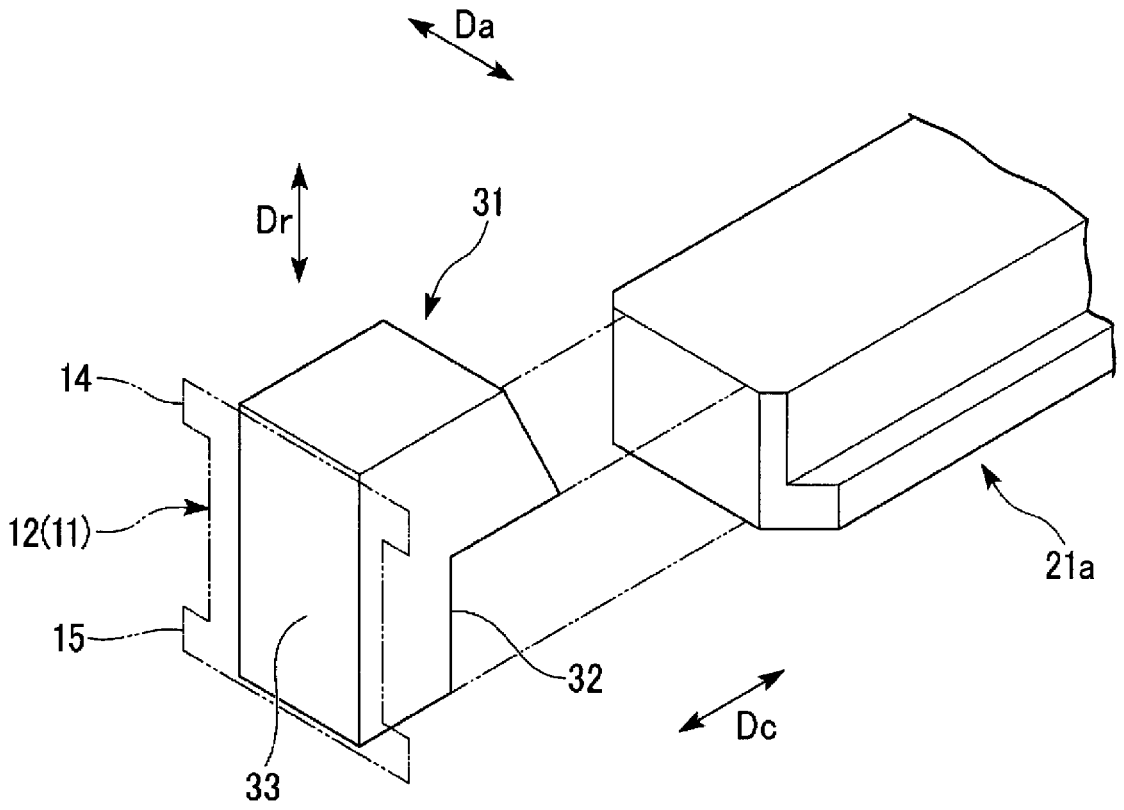
FIG. 18 is a perspective view of the main portion of a dummy ring assembly in a second modification of the first embodiment according to the present invention.

A second modification of the dummy ring assembly for removal according to the first embodiment will be described using FIG. 18.

The dummy ring assembly for removal according to this modification is configured by adding a pressing tool 31 to the dummy ring assembly for removal 20 according to the first embodiment.

The pressing tool 31 includes a dummy ring engagement portion 32 that makes contact with the first end surface 25 of the first dummy ring 21*a*, and a pressing portion 33 that makes contact with the outer shroud 15 and the inner shroud 14 of the vane 12, of the plurality of vanes 12 that constitute the vane segment 11, that is located at the end in the circumferential direction Dc.

In this modification, both the outer shroud 15 of the vane segment 11 within the vane ring groove 5*a* of the lower casing 5*d* and the inner shroud 14 of the vane segment 11 can be pressed in the circumferential direction Dc by pressing the first dummy ring 21*a* in the circumferential direction Dc. Accordingly, in this modification, the vane segments 11 within the lower casing 5*d* can be pressed smoothly in the circumferential direction Dc.

As illustrated in FIG. 2, the inner circumferential sides of almost all of the plurality of vane rings 10 face the outer circumferential surface of the rotor main body 3 of the compressor rotor 2. Accordingly, the inner circumferential sides of these vane rings 10 are not in contact with members located further on the inner circumferential sides thereof (the rotor main body 3, in this case). However, there are cases where the inner circumferential sides of some of the plurality of vane rings 10 are in contact with members located further on the inner circumferential sides thereof. For example, in the example illustrated in FIG. 2, the outer circumferential side of a vane ring 10*x* on the most downstream side makes contact with the compressor casing 5 and is attached to the compressor casing 5 like the other vane rings 10, while the inner circumferential side of the vane ring 10*x* makes contact with a combustor basket 5*x* of the compressor 1. In the case where vane segments 11*x* of this vane ring 10*x* are moved in the circumferential direction Dc, friction is produced with the compressor casing 5 present on the outer circumferential sides of the vane segments 11*x*, and friction is also produced with the combustor basket 5*x* present on the inner circumferential sides of the vane segments 11*x*. Accordingly, when removing such vane segments 11*x* from the compressor casing 5, it is preferable that the dummy ring assembly for removal according to this modification, which can press the outer circumferential sides and the inner circumferential sides of the vane segments 11*x*, be used.

Note that the same tapered surfaces as in the dummy rings of the first embodiment or the first modification thereof may also be formed in the pressing portion 33 side of the pressing tool 31.

Second Embodiment of Dummy Ring Assembly for Removing Vane Segments and Method of Removing Vane Segments Using the Same A second embodiment of a dummy ring assembly for removing vane segments and a method of removing vane segments using the same will be described using FIGS. 19 to 25.

Figure 19:
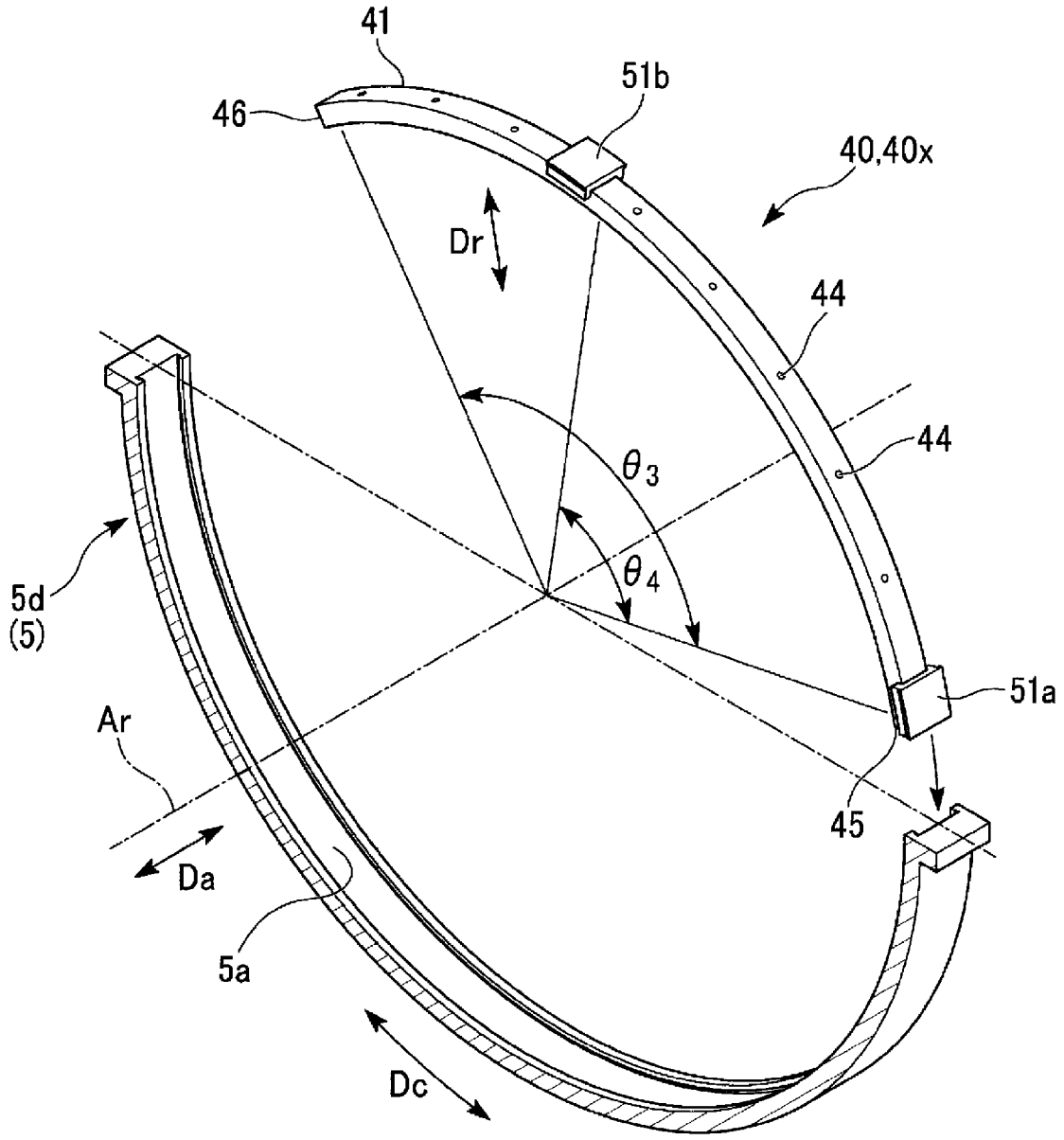
FIG. 19 is a perspective view of a dummy ring assembly for removal in a second embodiment according to the present invention.

As illustrated in FIG. 19, a dummy ring assembly for removal 40 according to the present embodiment includes an arc-shaped ring piece 41 centered on the rotational axis Ar, and groove attachments 51*a* and 51*b* that are fitted into the vane ring groove 5*a* of the lower casing 5*d*.

Like the dummy rings 21*a* and 21*b* according to the first embodiment, a plurality of thread holes 44 (fitment attachment portions) for attaching eye bolts (movement force application tools) are formed in the arc-shaped ring piece 41. The plurality of thread holes 44 are formed in the outer circumferential surface of the ring piece 41, arranged in the circumferential direction Dc. Furthermore, the thread holes 44 are also formed in both end surfaces of the ring piece 41 in the circumferential direction Dc, or in other words, in a first end surface 45 and a second end surface 46 (see FIG. 20).

The groove attachments 51*a* and 51*b* include an end portion groove attachment 51*a* that is removably attached to a first end portion 45*p* including the first end surface 45 of the ring piece 41 and a trunk section groove attachment 51*b* that is removably attached to the ring piece 41 so as to be distanced from the end portion groove attachment 51*a* in the circumferential direction Dc. A central angle θ3 of the arc-shaped ring piece 41 is less than 180°, namely 140°, for example. The arc length of the end portion groove attachment 51*a* and the arc length of the trunk section groove attachment 51*b* are much shorter than the arc length of the ring piece 41. To be more specific and express these as central angles, a central angle of the end portion groove attachment 51*a* and a central angle of the trunk section groove attachment 51*b* are both approximately 10°, for example. The trunk section groove attachment 51*b* is attached to a position at 70° (=θ4), around the rotational axis Ar, from the first end surface 45 of the ring piece 41.

Figure 25:
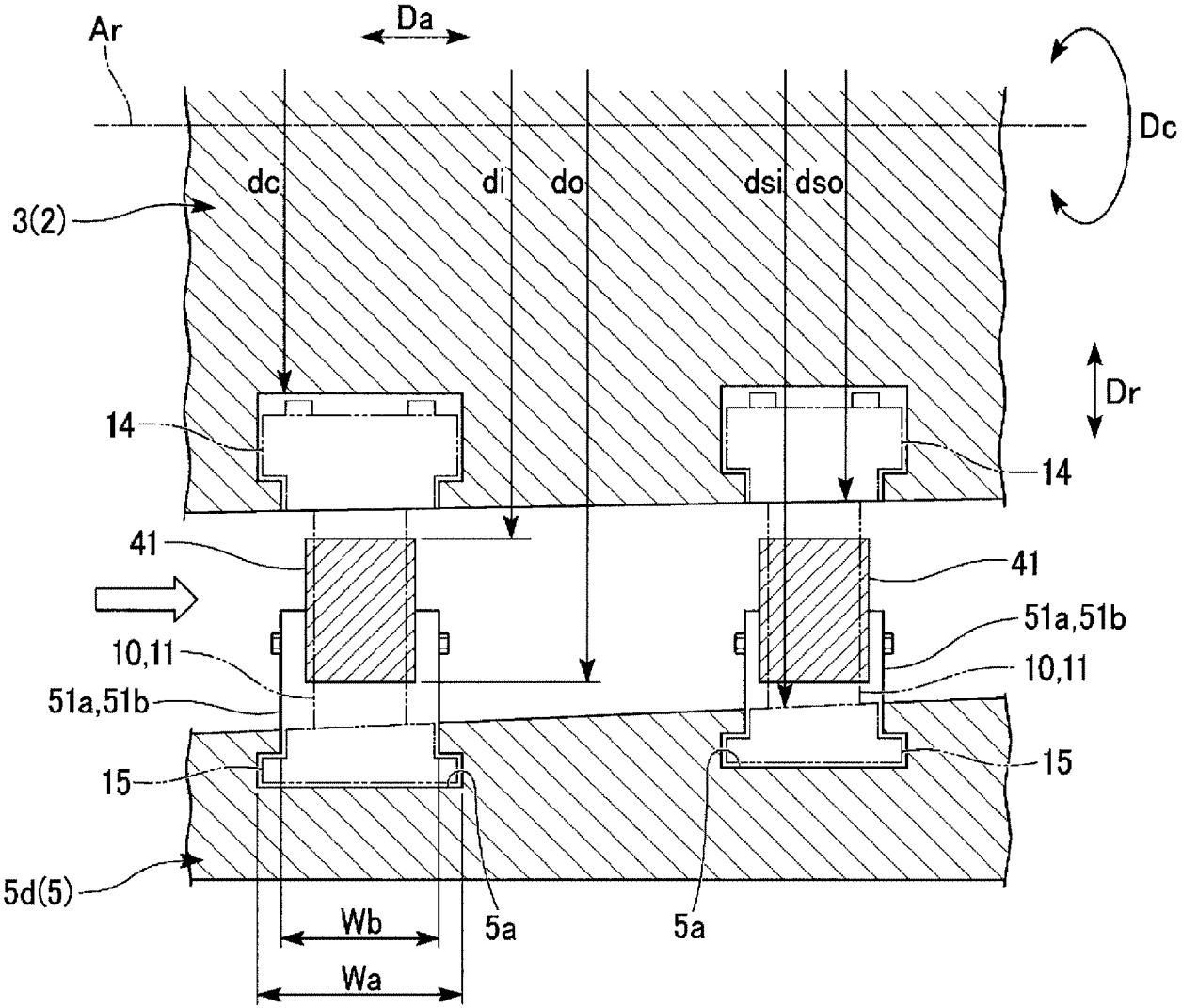
FIG. 25 is an explanatory diagram illustrating various dimensions of various elements of the dummy ring assembly for removal in the second embodiment according to the present invention.

As illustrated in FIG. 25, an inner diameter dimension di of the ring piece 41 is greater than an outer diameter dimension dso of the inner shroud 14 of each of the plurality of vane rings 10 that are adjacent in the axial direction Da. Meanwhile, an outer diameter dimension do of the ring piece 41 is smaller than an inner diameter dimension dsi of the outer shroud 15 of each of the plurality of vane rings 10 that are adjacent in the axial direction Da. Accordingly, the inner diameter dimension di and the outer diameter dimension do of the ring piece 41 are set to dimensions that enable the ring piece 41 to move in the axial direction Da within the primary flow channel of the compressor 1.

Figure 20:
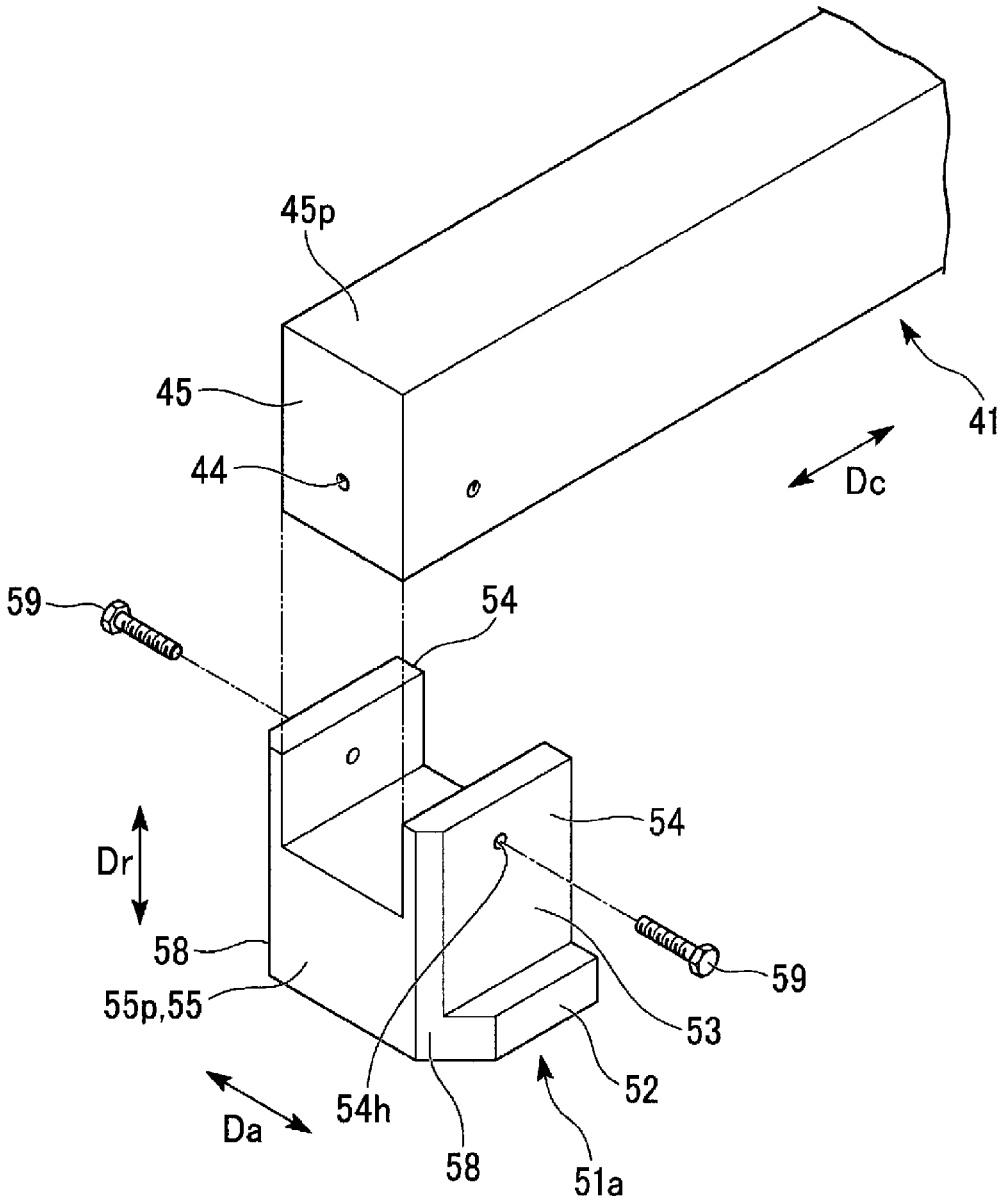
FIG. 20 is a perspective view of an end portion groove attachment in the second embodiment according to the present invention.
Figure 21:
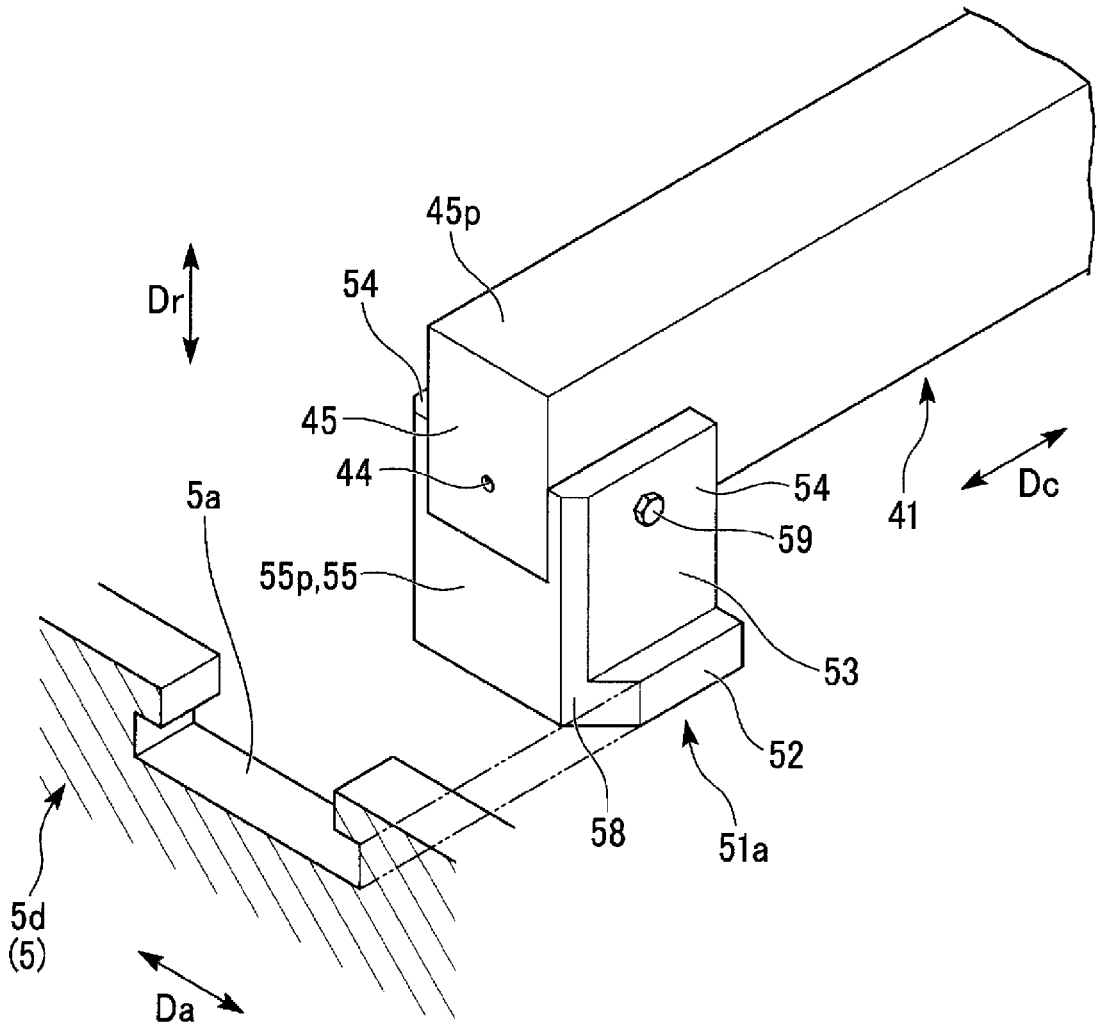
FIG. 21 is a perspective view illustrating the main portion of the dummy ring assembly for removal in the second embodiment according to the present invention.

As illustrated in FIGS. 20 and 21, the end portion groove attachment 51*a* includes a dummy shroud section 52 that is fitted into the vane ring groove 5*a*, an inner circumferential side portion 53 that protrudes from the dummy shroud section 52 toward the inner side in the radial direction, and a pair of attachment portions 54 and 54 that further project from the inner circumferential side portion 53 toward the inner side in the radial direction and that face each other in the axial direction Da. Bolt insertion holes 54*h* are formed in the pair of attachment portions 54 and 54 so as to pass therethrough in the axial direction Da. Like the dummy rings 21*a* and 21*b* according to the first embodiment, a tapered surface 58 is formed in a first end portion 55*p* that includes a first end surface 55 of the end portion groove attachment 51*a* in the circumferential direction Dc.

When attaching the end portion groove attachment 51*a* to the ring piece 41, the first end surface 55 of the end portion groove attachment 51*a* is first oriented in the direction in which the first end surface 45 of the ring piece 41 is oriented. Next, the first end portion 45*p* of the ring piece 41 is positioned between the pair of attachment portions 54 and 54 of the end portion groove attachment 51*a*. Then, bolts 59 are inserted into the respective bolt insertion holes 54*h* of the pair of attachment portions 54 and 54, and the bolts 59 are screwed into the ring piece 41. This completes the attachment of the end portion groove attachment 51*a* to the ring piece 41.

Figure 22:
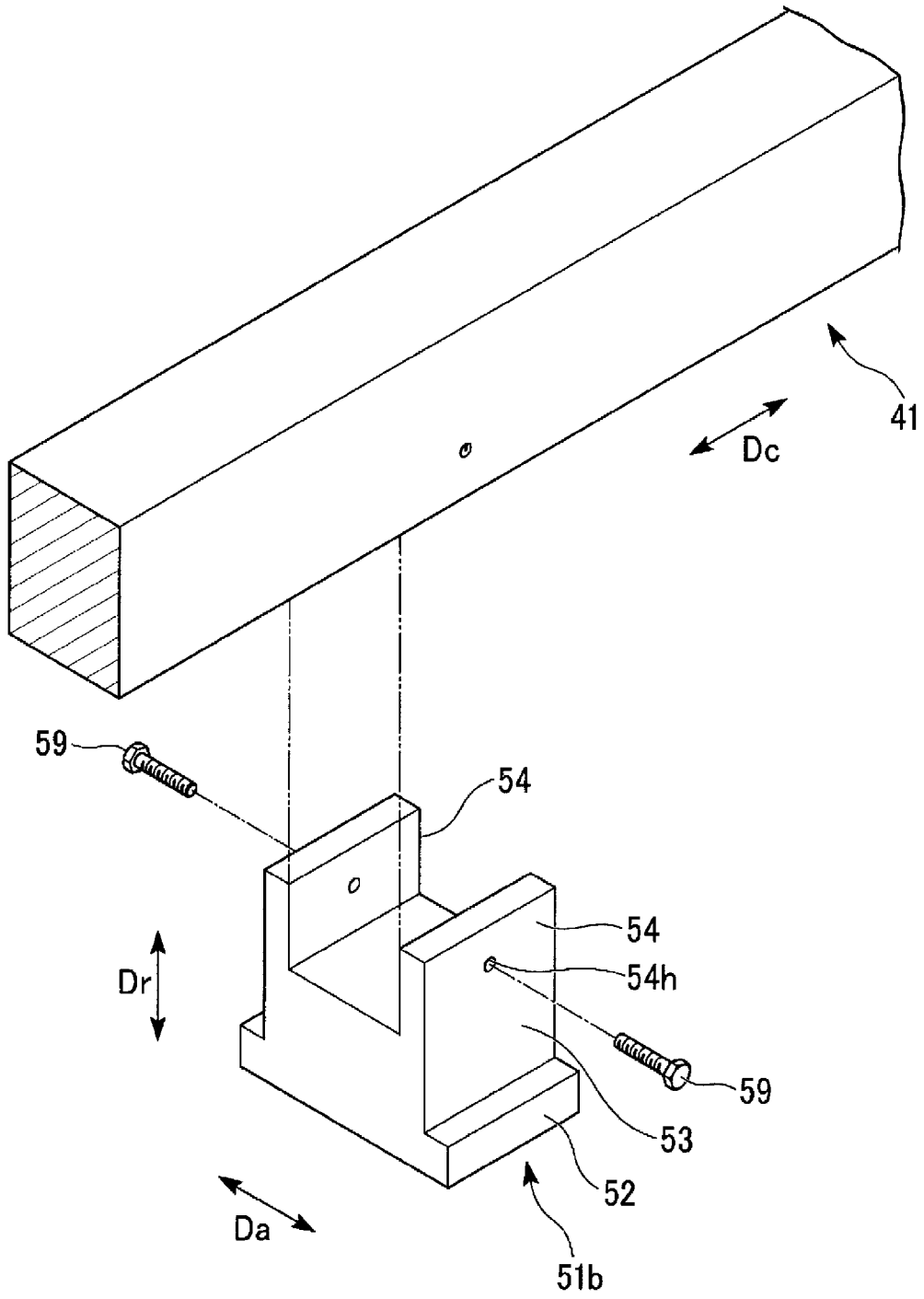
FIG. 22 is a perspective view of a trunk section groove attachment in the second embodiment according to the present invention.

As illustrated in FIG. 22, like the end portion groove attachment 51*a*, the trunk section groove attachment 51*b* includes a dummy shroud section 52 that is fitted into the vane ring groove 5*a*, an inner circumferential side portion 53 that protrudes from the dummy shroud section 52 toward the inner side in the radial direction, and a pair of attachment portions 54 and 54 that further project from the inner circumferential side portion 53 toward the inner side in the radial direction and that face each other in the axial direction Da. The bolt insertion holes 54*h* are formed in the pair of attachment portions 54 and 54 so as to pass therethrough in the axial direction Da. A tapered surface like the tapered surface 58 of the end portion groove attachment 51*a* is not formed in the trunk section groove attachment 51*b*. However, a tapered surface like the tapered surface 58 of the end portion groove attachment 51*a* may be formed in the trunk section groove attachment 51*b*. In other words, the trunk section groove attachment 51*b* may have exactly the same shape as the end portion groove attachment 51*a*.

As when attaching the end portion groove attachment 51*a* to the ring piece 41, the ring piece 41 is positioned between the pair of attachment portions 54 and 54 of the trunk section groove attachment 51*b* when attaching the trunk section groove attachment 51*b* to the ring piece 41 as well. Then, the bolts 59 are inserted into the respective bolt insertion holes 54*h* of the pair of attachment portions 54 and 54, and the bolts 59 are screwed into the ring piece 41. Note that the structure for removably attaching the end portion groove attachment 51*a* and the trunk section groove attachment 51*b* to the ring piece 41 need not be the structure described above as long as the end portion groove attachment 51*a* and the trunk section groove attachment 51*b* can be attached to and removed from the ring piece 41.

As illustrated in FIG. 25, the plurality of vane ring grooves 5*a* formed in the compressor casing 5 are different from each other in dimensions, such as a groove width Wa in the axial direction Da, a groove opening width Wb in the axial direction Da, and a distance dc from the rotational axis Ar to the groove bottom face. Accordingly, the end portion groove attachment 51*a* and the trunk section groove attachment 51*b* are manufactured for each of the plurality of vane ring grooves 5*a*, and the various dimensions thereof are set in accordance with the corresponding vane ring groove 5*a*.

Next, a procedure for removing the vane segments 11 using the above-described dummy ring assembly for removal 40 will be described.

First, as in the first embodiment, the compressor casing 5 is disassembled and the upper casing 5*u* is removed. Next, as illustrated in FIG. 19, the end portion groove attachment 51*a* and the trunk section groove attachment 51*b* corresponding to one of the vane ring grooves 5*a* in the lower casing 5*d* are attached to the ring piece 41. In other words, an assembly 40*x* corresponding to that vane ring groove 5*a* is prepared (a preparation step).

Next, as in the first embodiment, of the four vane segments 11 that are attached to the one of the vane ring grooves 5*a* in the lower casing 5*d*, the first vane segment 11*a* and the fourth vane segment 11*d*, which are the vane segments 11 located on both ends in the circumferential direction Dc, are moved in the circumferential direction Dc and pulled out from the lower casing 5*d*.

Figure 23:
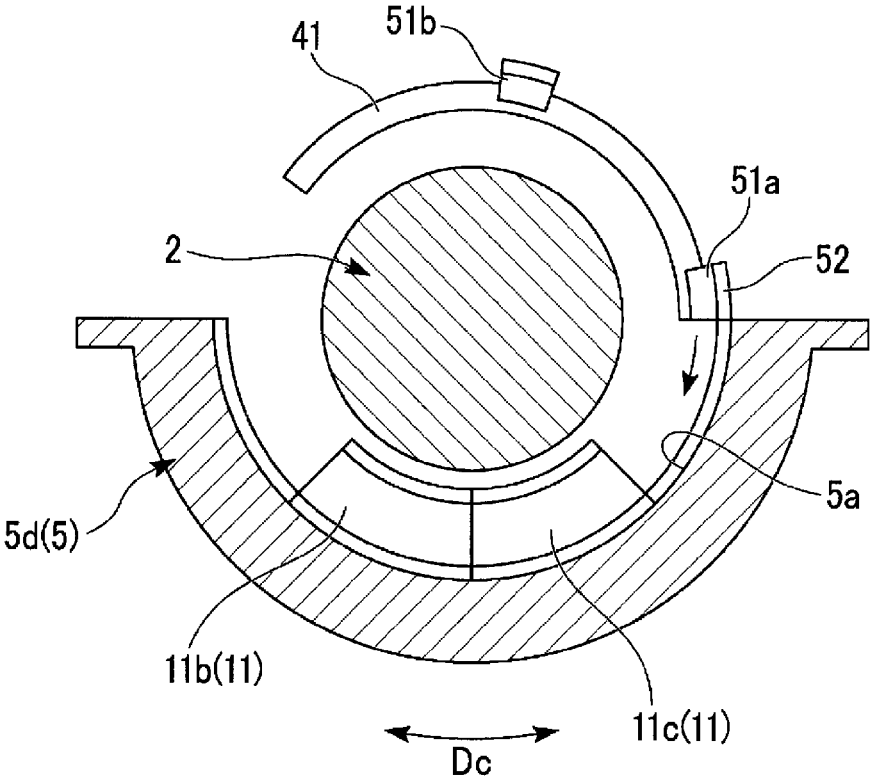
FIG. 23 is an explanatory diagram (No. 1) illustrating a procedure for removing vane segments in the second embodiment according to the present invention.

Next, as illustrated in FIG. 23, the assembly 40*x* prepared earlier is placed upon the lower casing 5*d*. At this time, the dummy shroud section 52 of the end portion groove attachment 51*a* of the assembly 40*x* faces the opening at the end of the vane ring groove 5*a* of the lower casing 5*d* in the circumferential direction Dc. The dummy shroud section 52 is then inserted into the vane ring groove 5*a* of the lower casing 5*d*. As described above, the tapered surface 58 is formed in the first end portion 55*p* of the end portion groove attachment 51*a*, and thus the dummy shroud section 52 can be inserted into the vane ring groove 5*a* with ease.

Figure 24:
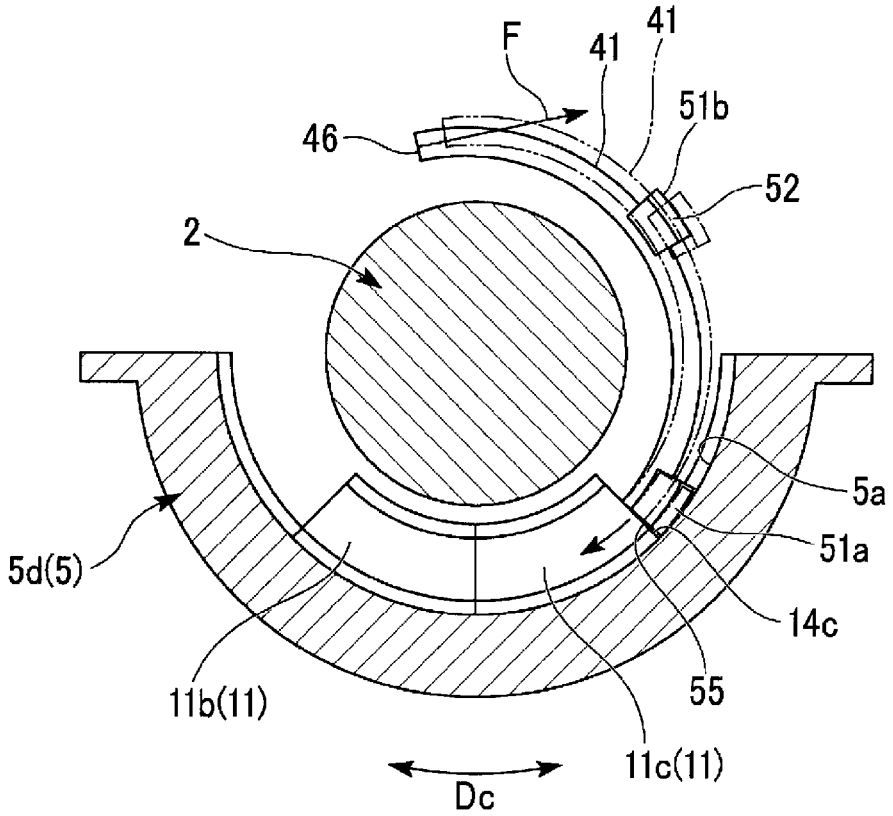
FIG. 24 is an explanatory diagram (No. 2) illustrating the procedure for removing vane segments in the second embodiment according to the present invention.

After the end portion groove attachment 51*a* of the assembly 40*x* has been inserted into the vane ring groove 5*a*, the assembly 40*x* is moved along the vane ring groove 5*a* in the circumferential direction Dc (a movement step). As illustrated in FIG. 24, upon the assembly 40*x* being moved in the circumferential direction Dc, the first end surface 55 of the end portion groove attachment 51*a* makes contact with the end surface 14*c* in the circumferential direction Dc of the third vane segment 11*c* that remains within the lower casing 5*d*. Then, upon the assembly 40*x* being moved further in the circumferential direction Dc while the first end surface 55 of the end portion groove attachment 51*a* is in contact with the end surface 14*c* in the circumferential direction Dc of the third vane segment 11*c*, the third vane segment 11*c* and the second vane segment 11*b* also move in the circumferential direction Dc in response to the assembly 40*x* moving in the circumferential direction Dc. At this time, a chain block is used in the case where friction between the third and second vane segments 11*c* and 11*b* and the lower casing 5*d* makes it difficult to manually move the assembly 40*x* in the circumferential direction Dc, as described in the first embodiment.

Here, assume that the perpendicular force F is applied to the second end surface 46 of the ring piece 41 in order to move the assembly 40*x* in the circumferential direction Dc even after the first end surface 55 of the end portion groove attachment 51*a* has made contact with the end surface 14*c* of the vane segment 11 mounted in the lower casing 5*d*. This force F acts as a bending moment on the ring piece 41. As such, the ring piece 41 deforms with the position where the end portion groove attachment 51*a* is attached serving as a fulcrum, as indicated by a long dashed double-short dashed line in FIG. 24. However, the ring piece 41 is not fitted into the vane ring groove 5*a*, and thus even if the ring piece 41 does deform slightly, it is not difficult for the assembly 40*x* to move along the vane ring groove 5*a*, unlike the dummy ring 21*c* according to the comparative example in the first embodiment described above.

When the assembly 40*x* is moved further in the circumferential direction Dc, the dummy shroud section 52 of the trunk section groove attachment 51*b* of the assembly 40*x* faces the opening at the end of the vane ring groove 5*a* of the lower casing 5*d* in the circumferential direction Dc. At this time, when the ring piece 41 is deformed as described above, the dummy shroud section 52 of the trunk section groove attachment 51*b* does not enter into the vane ring groove 5*a* of the lower casing 5*d*. Accordingly, the force applied to the ring piece 41 is temporarily released, returning the ring piece 41 to an undeformed state. The dummy shroud section 52 of the trunk section groove attachment 51*b* is then inserted into the vane ring groove 5*a* of the lower casing 5*d*. Then, in the same manner as described above, a force is applied to the ring piece 41 and the assembly 40*x* is moved in the circumferential direction Dc. The assembly 40*x* is supported relative to the vane ring groove 5*a* at two locations, namely by the end portion groove attachment 51*a* and the trunk section groove attachment 51*b*, during the process of moving the assembly 40*x* in the circumferential direction Dc after the end portion groove attachment 51*a* and the trunk section groove attachment 51*b* of the assembly 40*x* have been fitted into the vane ring groove 5*a*. Accordingly, the assembly 40*x* can be moved smoothly along the vane ring groove 5*a*.

Note that the ring piece 41 also deforms as described above in the case where the perpendicular force F is applied to the second end surface 46 of the ring piece 41 to move the assembly 40*x* in the circumferential direction Dc after the end portion groove attachment 51*a* and the trunk section groove attachment 51*b* have been fitted into the vane ring groove 5*a*. However, the deformation of the ring piece 41 is not deformation with the position where the end portion groove attachment 51*a* is attached serving as a fulcrum, but rather is deformation with the position where the trunk section groove attachment 51*b* is attached serving as a fulcrum. This deformation amount is lower than the deformation amount of the ring piece 41 with the position where the end portion groove attachment 51*a* is attached serving as a fulcrum. Accordingly, the ring piece 41 does not enter into the vane ring groove 5*a* in this case as well.

Upon the end portion of the second vane segment 11*b* in the circumferential direction Dc protruding from the lower casing 5*d* in the circumferential direction Dc due to the third vane segment 11*c* and the second vane segment 11*b* moving in the circumferential direction Dc in response to the assembly 40$x$ moving in the circumferential direction Dc, the second vane segment 11$b$ is pulled out from the lower casing 5$d$ (a segment pullout step). Furthermore, upon the end portion of the third vane segment 11$c$ in the circumferential direction Dc protruding from the lower casing 5$d$ in the circumferential direction Dc due to the third vane segment 11$c$ moving in the circumferential direction Dc in response to the assembly 40$x$ moving in the circumferential direction Dc, the third vane segment 11$c$ is pulled out from the lower casing 5$d$ (a segment pullout step).

All of the vane segments 11 in the one of the vane ring grooves 5$a$ are thus removed from the lower casing 5$d$.

Next, the assembly 40$x$ remaining within the lower casing 5$d$ is removed from the lower casing 5$d$. At this time, an eye bolt is screwed into the thread hole 44 formed in the second end surface 46 of the ring piece 41, and the assembly 40$x$ is pulled out from the lower casing 5$d$ by applying a force to the ring portion of the eye bolt in the pullout direction.

Next, the assembly 40$x$ that has been pulled out from the lower casing 5$d$ is disassembled, and the end portion groove attachment 51$a$ and the trunk section groove attachment 51$b$ are removed from the ring piece 41.

Next, the end portion groove attachment 51$a$ and the trunk section groove attachment 51$b$ corresponding to another vane ring groove 5$a$ are attached to the ring piece 41, and a new assembly 40$x$ is prepared (the preparation step).

The plurality of vane segments 11 attached to this other vane ring groove 5$a$ are then removed from the lower casing 5$d$ through the same process as the process carried out on the plurality of vane segments 11 attached to the one of the vane ring grooves 5$a$ described above.

In other words, the preparation step, the movement step, and the segment pullout step are carried out for each of the plurality of vane ring grooves 5$a$, thus removing the plurality of vane segments 11 attached to the plurality of vane ring grooves 5$a$ from the lower casing 5$d$ in sequence.

The ring piece 41 according to the present embodiment is not fitted into the vane ring groove 5$a$, and thus the cross-sectional shape of the ring piece 41 may be a simple quadrangle, for example, and the movement of the vane segments 11 in the circumferential direction will not be significantly inhibited even if the curve of the arc shape is not very precise. As such, although the ring piece 41 has a central angle of greater than or equal to 90°, the ring piece 41 can be manufactured cheaply. Furthermore, in the present embodiment, the same ring piece 41 can be used for the assemblies 40$x$ respectively prepared for the plurality of vane ring grooves 5$a$. The cost of removing the vane segments 11 can therefore be suppressed according to the present embodiment.

Although the central angle of the ring piece 41 according to the present embodiment is greater than or equal to 90° and less than 180°, the angle may be set to less than 90° and, as in the first embodiment, the assembly 40$x$ may be constituted of a plurality of the ring pieces 41 and the groove attachments 51$a$ and 51$b$ mounted on each of the ring pieces 41.

In addition, in the above embodiments, descriptions have been given of an example of the compressor 1 provided with the vane rings 10; however, the present invention is not limited to this example, and the present invention may be applied to other rotary machines, for example, a steam turbine or the like, as long as a vane ring is provided.

INDUSTRIAL APPLICABILITY

According to an aspect of the present invention, the cost of removing vane segments from a casing can be suppressed.

REFERENCE SIGNS LIST

1 Compressor (Rotary machine)
2 Compressor rotor
3 Rotor main body
5 Compressor casing
5$a$ Vane ring groove
5$u$ Upper casing
5$d$ Lower casing
6 Combustor
7 Turbine
10 Vane ring
11 Vane segment
12 Vane
13 Vane body
14 Inner shroud
15 Outer shroud
18 Linking holder
19 Linking band
20, 40 Dummy assembly for removal
21$a$, 21$b$, 21$c$ Dummy ring
21$a$, 21$d$ First dummy ring
21$b$ Second dummy ring
22 Dummy shroud section
23 Inner circumferential side ring portion
24 Thread hole (fitment attachment portion)
25 First end surface
25$p$ First end portion
26 Second end surface
28$u$, 28$ud$, 28$d$, 28$dd$ Tapered surface
31 Pressing tool
32 Dummy ring engagement portion
33 Pressing portion
40$x$ Assembly
41 Ring piece
51$a$, 51$b$ Groove attachment
51$a$ End portion groove attachment
51$b$ Trunk section groove attachment
52 Dummy shroud section
58 Tapered surface
91 Eye bolt (movement force application tool)

The invention claimed is:

1. A dummy ring assembly for removing vane segments of a rotary machine, the rotary machine including a cylindrical casing centered on an axial line and a vane ring mounted in a vane ring groove, the vane ring groove having an annular shape centered on the axial line and being formed on an inner circumferential side of the casing, the casing being able to be split into a plurality of partial casings in a circumferential direction centered on the axial line, and the vane ring being able to be split into a plurality of vane segments in the circumferential direction, the dummy ring assembly comprising:

a plurality of dummy rings, each of the dummy rings having a dummy shroud section capable of being fitted into the vane ring groove, each of the dummy rings having an arc shape whose central angle centered on the axial line is less than 90°, and being capable of moving in the circumferential direction along the vane ring groove, wherein at least one of the plurality of dummy rings is a first dummy ring having a first end portion including a first end surface among the first end surface and a second end surface in the circumferential direction of the dummy shroud section, wherein on one side and another side in an axial direction of the first end portion, a tapered surface is formed so that a width of the dummy shroud section in the axial direction gradually increases as the dummy shroud section extends from the first end surface toward the second end surface in the circumferential direction, wherein the first end surface is slanted so as to gradually extend from the second end surface toward the first end surface in the circumferential direction as the first end surface extends from the one side toward the another side in the axial direction, and wherein an angle of the tapered surface relative to the circumferential direction at the another side in the axial direction is smaller than an angle of the tapered surface relative to the circumferential direction at the one side in the axial direction.

2. The dummy ring assembly for removing vane segments according to claim 1, wherein a total of the central angles of the plurality of dummy rings is greater than an angle obtained by subtracting a central angle of one of the vane segments from a central angle of one of the partial casings.

3. The dummy ring assembly for removing vane segments according to claim 1, wherein, when the central angle of one of the partial casings is 180° and the central angle of one of the vane segments is 45°, two of the dummy rings are provided, and each of the two dummy rings has a central angle greater than or equal to 70° and less than 90°.

4. The dummy ring assembly for removing vane segments according to claim 1, wherein each of the dummy rings includes a fitment attachment portion for attaching a movement force application tool that applies a force for moving the dummy ring in the circumferential direction.

5. The dummy ring assembly for removing vane segments according to claim 4, wherein the fitment attachment portion is formed in a surface of each of the dummy rings in the circumferential direction.

6. The dummy ring assembly for removing vane segments according to claim 4, wherein a plurality of the fitment attachment portions are formed in an outer circumferential surface of each of the arc-shaped dummy rings so as to be arranged in the circumferential direction.

7. The dummy ring assembly for removing vane segments according to claim 1, further comprising a pressing tool that is attached so as to be in contact with a surface of one of the dummy rings in the circumferential direction, the pressing tool being configured to make contact with an end surface in the circumferential direction of an outer shroud of one of the vane segments and an end surface in the circumferential direction of an inner shroud of the one of the vane segments, and to press the one of the vane segments in response to the one of the dummy rings moving.

8. The dummy ring assembly for removing vane segments according to claim 1, wherein the dummy rings are each formed from an aluminum alloy.

9. The dummy ring assembly for removing vane segments according to claim 1, wherein an outer diameter of the dummy rings is substantially the same as an inner diameter of a groove bottom face of the vane ring groove.

10. A method of removing vane segments in which the vane segments are removed from one of the partial casings by using the dummy ring assembly for removing vane segments according to claim 1, the method comprising:

a first movement step of moving the first dummy ring in the circumferential direction by fitting the dummy shroud section of the first dummy ring into the vane ring groove of the one of the partial casings by making the dummy shroud section face the opening at the end of the vane ring groove of the partial casing in the circumferential direction and then inserting the dummy shroud section into the vane ring groove starting with the first end portion of the dummy shroud section;

a second movement step of moving a remaining second dummy ring of the plurality of dummy rings in the circumferential direction along with the first dummy ring by fitting the dummy shroud section of the second dummy ring into the vane ring groove of the one of the partial casings once the entirety in the circumferential direction of the dummy shroud section of the first dummy ring is within the vane ring groove of the one of the partial casings and butting the second dummy ring against the first dummy ring; and a segment pullout step of pulling out, from the one of the partial casings, one of the vane segments that has protruded from the vane ring groove of the one of the partial casings due to either one of the first movement step and the second movement step being executed.

* * * * *